US009424773B2

(12) United States Patent
Takanohashi et al.

(10) Patent No.: US 9,424,773 B2
(45) Date of Patent: Aug. 23, 2016

(54) DISPLAY PANEL, METHOD OF DRIVING THE SAME, AND ELECTRONIC APPARATUS

(71) Applicant: Sony Corporation, Tokyo (JP)

(72) Inventors: Kazukuni Takanohashi, Tokyo (JP); Hideyuki Suzuki, Kanagawa (JP); Toshiyuki Miyauchi, Kanagawa (JP); Tamotsu Ikeda, Tokyo (JP)

(73) Assignee: Sony Corporation, Tokyo (JP)

( * ) Notice: Subject to any disclaimer, the term of this patent is extended or adjusted under 35 U.S.C. 154(b) by 26 days.

(21) Appl. No.: 14/453,866

(22) Filed: Aug. 7, 2014

(65) Prior Publication Data

US 2015/0062204 A1 Mar. 5, 2015

(30) Foreign Application Priority Data

Aug. 29, 2013 (JP) ..... 2013-177540

(51) Int. Cl.
*G09G 3/32* (2016.01)

(52) U.S. Cl.
CPC ..... *G09G 3/3208* (2013.01); *G09G 2320/0233* (2013.01)

(58) Field of Classification Search
CPC ..... G09G 3/3208; G09G 2320/0233; G09G 3/3644; G09G 3/3625; G09G 5/397
See application file for complete search history.

(56) References Cited

U.S. PATENT DOCUMENTS

2004/0056854 A1* 3/2004 Kondo ..... G09G 3/20 345/204
2005/0062711 A1* 3/2005 Kobayashi ..... G09G 3/20 345/100

FOREIGN PATENT DOCUMENTS

JP 2012-032828 2/2012

* cited by examiner

*Primary Examiner* — Premal Patel
(74) *Attorney, Agent, or Firm* — K&L Gates LLP

(57) ABSTRACT

A display panel includes: a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels.

23 Claims, 33 Drawing Sheets

DISPLAY PANEL, METHOD OF DRIVING THE SAME, AND ELECTRONIC APPARATUS

CROSS REFERENCES TO RELATED APPLICATIONS

The present application claims priority to Japanese Priority Patent Application JP 2013-177540 filed in the Japan Patent Office on Aug. 29, 2013, the entire content of which is hereby incorporated by reference.

BACKGROUND

The present disclosure relates to a display panel that displays an image, a method of driving such a display panel, and an electronic apparatus including such a display panel.

Recently, in the field of display panels that display an image, display panels (organic EL (Electro Luminescence) display panels) using, as light-emitting devices, current drive type optical devices with light emission luminance changeable according to a value of a current flowing therethrough, for example, organic EL devices have been developed for commercialization. Unlike liquid crystal devices and the like, the organic EL devices are self-luminous devices; therefore, in the organic EL devices, a light source (a backlight) is not necessary. Accordingly, the organic EL display panels have characteristics such as higher image visibility, lower power consumption, and higher response speed of a device, compared to liquid crystal display panels needing a light source.

For example, Japanese Unexamined Patent Application Publication No. 2012-32828 discloses a so-called active matrix display panel in which a thin film transistor (TFT) is provided to each pixel to control light emission of an organic EL device in each pixel. This display panel includes a plurality of gate lines extending along a horizontal direction and a plurality of data lines extending along a vertical direction, and respective pixels are disposed around respective intersections of the gate lines and the data lines. Then, pixels are selected line by line, based on a gate line signal, and an analog pixel voltage is written to the selected pixels.

SUMMARY

Display panels are used in various applications such as monitors of personal computers, televisions, and portable electronic apparatuses typified by smartphones. In a case where the display panel is used for a monitor or the like, the display panel mainly displays a still image. Moreover, in a case where the display panel is used for a television, the display panel mainly displays a moving image. Thus, features of a displayed image differ according to applications or the like, and desired characteristics of the display panel also differ accordingly. Therefore, it is desirable that the display panel have high flexibility so as to support various applications.

It is desirable to provide a display panel capable of enhancing flexibility of a display operation, a driving method, and an electronic apparatus.

According to an embodiment of the present disclosure, there is provided a display panel including: a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels.

According to an embodiment of the present disclosure, there is provided a driving method including: generating first pixel packets, the first pixel packets each including luminance data of a digital signal, the pieces of luminance data determining respective luminances of respective predetermined number of unit pixels of a plurality of unit pixels, and the first pixel packets being equal in number to the predetermined number of unit pixels; and supplying the first pixel packets to a display section including the plurality of unit pixels.

According to an embodiment of the present disclosure, there is provided an electronic apparatus provided with a display panel and a control section, the control section configured to perform operation control on the display panel, the display panel including: a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels. The electronic apparatus may correspond to, for example, a personal computer, a monitor, a television, a smartphone, a digital camera, a video camera, or the like.

In the display panel, the driving method, and the electronic apparatus, the first pixel packets each including the luminance data are generated, and are supplied to the display section. At this time, the first pixel packets including the luminance data that determine respective luminance of respective predetermined number of unit pixels of the plurality of unit pixels, and being equal in number to the predetermined number of unit pixels are generated.

In the display panel, the driving method, and the electronic apparatus according to the embodiments of the present disclosure, the first pixel packets each including the luminance data that determine respective luminance of respective predetermined number of unit pixels of the plurality of unit pixels, and being equal in number to the predetermined number of unit pixels are generated; therefore, flexibility of a display operation is allowed to be enhanced.

It is to be understood that both the foregoing general description and the following detailed description are exemplary, and are intended to provide further explanation of the technology as claimed.

Additional features and advantages are described herein, and will be apparent from the following Detailed Description and the figures.

BRIEF DESCRIPTION OF THE FIGURES

The accompanying drawings are included to provide a further understanding of the technology, and are incorporated in and constitute a part of this specification. The drawings illustrate embodiments and, together with the specification, serve to explain the principles of the technology.

DETAILED DESCRIPTION

Some embodiments of the present disclosure will be described in detail below referring to the accompanying drawings. It is to be noted that description will be given in the following order.

1. First Embodiment
2. Second Embodiment
3. Third Embodiment
4. Application Examples (1. First Embodiment)

[Configuration Example]

Figure 1:
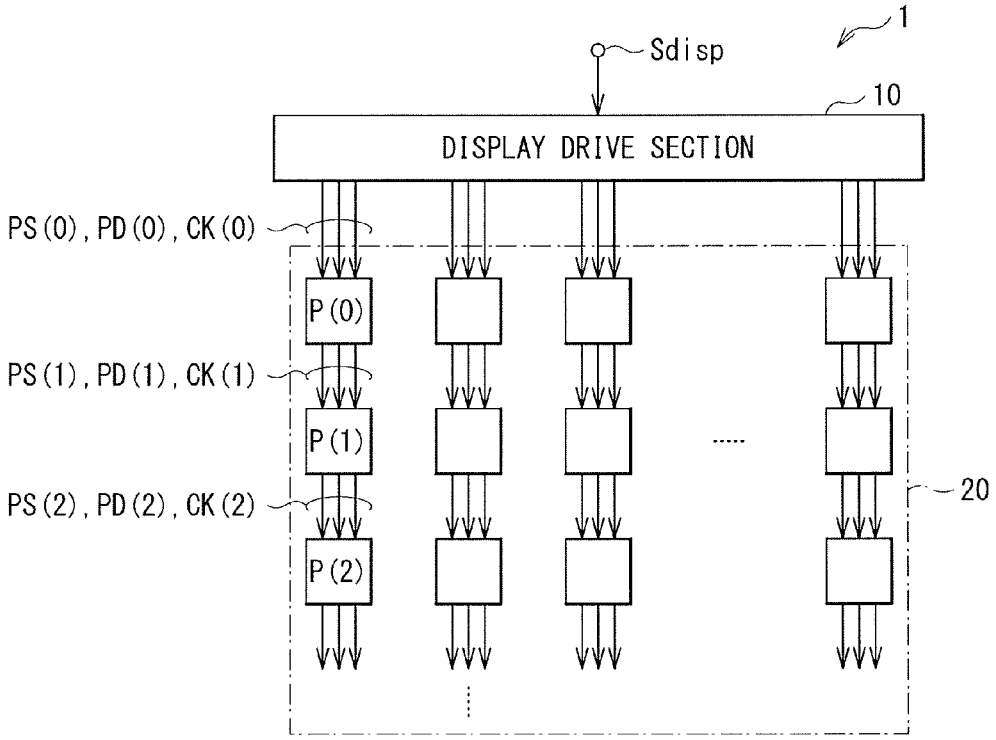
FIG. 1 is a block diagram illustrating a configuration example of a display panel according to a first embodiment of the present disclosure.

FIG. 1 illustrates a configuration example of a display panel according to a first embodiment. A display panel 1 is a display panel using an LED (Light Emitting Diode) as a display device. It is to be noted that a driving method and an electronic apparatus according to embodiments of the present disclosure are embodied by this embodiment, and will be also described below. The display panel 1 includes a display drive section 10 and a display section 20.

The display drive section 10 is configured to control light emission of each pixel P (that will be described later) of the display section 20, based on an image signal Sdisp. More specifically, as will be described later, the display drive section 10 is configured to control light emission of each pixel P by supplying data signals PS and PD and a clock signal CK to each pixel column of the pixels P in the display section 20.

The display section 20 includes a plurality of pixels P arranged in a matrix form. More specifically, in this example, the pixels P are arranged in a matrix of M pixels wide (horizontal) by N pixels high (vertical). N number of pixels P (P(0) to P(N−1)) arranged side by side along a vertical direction are connected in a daisy chain fashion. The display drive section 10 supplies the data signals PS and PD (PS(0) and PD(0)) and the clock signal CK (CK(0)) to the pixel P(0) in a first stage of the N number of pixels P connected in a daisy chain fashion. The pixel P(0) generates the data signals PS and PD (PS(1) and PD(1)) and the clock signal CK (CK(1)), based on the data signals PS(0) and PD(0) and the clock signal CK(0), and supplies these signals to the pixel P(1) subsequent to the pixel P(0). The subsequent pixel P(1) generates the data signals PS and PD (PS(2) and PD(2)) and the clock signal CK (CK(2)), and supplies these signals to the pixel P(2) subsequent to the pixel P(1). This is applicable to subsequent pixels P(2) to P(N−2). Then, the pixel P(N−1) in a last stage is configured to receive the data signals PS and PD (PS(N−1) and PD(N−1)) and the clock signal CK (CK(N−1)) that are generated by the pixel P(N−2) previous to the pixel P(N−1). Thus, the pixels P are connected in a daisy chain fashion with respect to the data signals PS and PD, and the pixels P are connected in a daisy chain fashion with respect to the clock signal CK.

Figure 2:
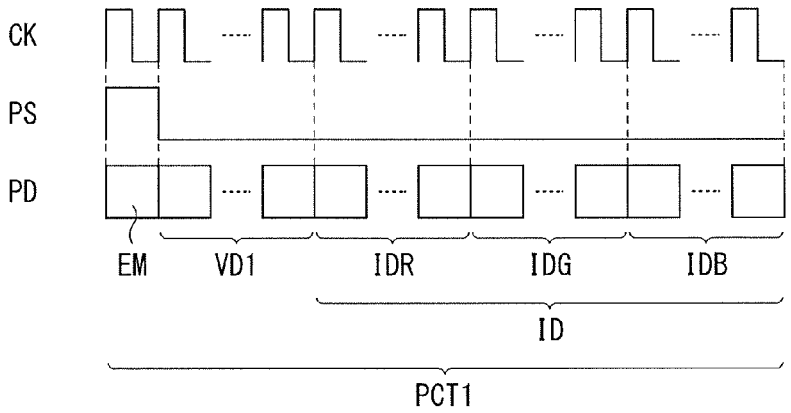
FIG. 2 is an explanatory diagram illustrating a configuration example of a pixel packet according to the first embodiment.

FIG. 2 illustrates a configuration example of the data signals PS and PD. FIG. 2 illustrates the data signals PS and PD for one pixel P. In other words, the display drive section 10 supplies the data signal PS and the data signal PD configured of a series of pixel packets PCT1 illustrated in FIG. 2 to the N number of pixels P connected in a daisy chain fashion. Hereinafter, the data signal PD for one pixel P may be also referred to as "pixel packet PCT1".

The data signal PD includes luminance data ID, a flag EM, and variable data VD1. The luminance data ID is configured to determine light emission luminance in each pixel P. The luminance data ID includes luminance data IDR indicating red (R) light emission luminance, luminance data IDG indicating green (G) light emission luminance, and luminance data IDB indicating blue (B) light emission luminance. In this example, each of the luminance data IDR, IDG, and IDB is a code of 12 bits. It is to be noted that each of the luminance data IDR, IDG, and IDB is not limited thereto, and, for example, each of the luminance data IDR, IDG, and IDB may be a code of 13 or more bits or 11 or less bits. The flag EM is a flag configured to determine whether each pixel P performs an operation of reading the luminance data ID or a light emission operation. More specifically, in this example, in a case where the flag EM is "0", the pixel P reads the luminance data ID in the pixel packet PCT1, and in a case where the flag EM is "1", the pixel P performs the light emission operation. The variable data VD1 is data configured to determine whether or not each pixel P reads the luminance data ID included in the pixel packet PCT1, and indicates a value of 0 to (M−1) both inclusive. More specifically, as will be described later, while each pixel P decrements the value of the variable data VD1, the pixel P reads the luminance data ID in a case where the variable data VD1 is "0". In this example, the flag EM, the variable data VD1, and the luminance data ID are arranged in this order in the pixel packet PCT1.

The data signal PS is a signal that is turned to "1" in a case where the data signal PD indicates the flag EM, and is turned to "0" in other cases. In other words, the data signal PS is a signal that is turned to "1" only at the start of each pixel packet PCT1.

Each pixel P receives the data signals PS and PD and the clock signal CK from the pixel P previous thereto, and generates new data signals PS and PD and a new clock signal CK, based on these received signals, and supplies the generated signals to the pixel P subsequent thereto. In a case where the flag EM in each pixel packet PCT1 is "0", each pixel P reads variable data VD1 in the pixel packet PCT1. Then, each pixel P decrements the value of the variable data VD1, and in a case where the value of the variable data VD1 is "0", each pixel P reads the luminance data ID in the pixel packet PCT1. Moreover, in a case where the flag EM is "1", each pixel P emits light with light emission luminance according to the luminance data ID that has been already read.

Figure 3:
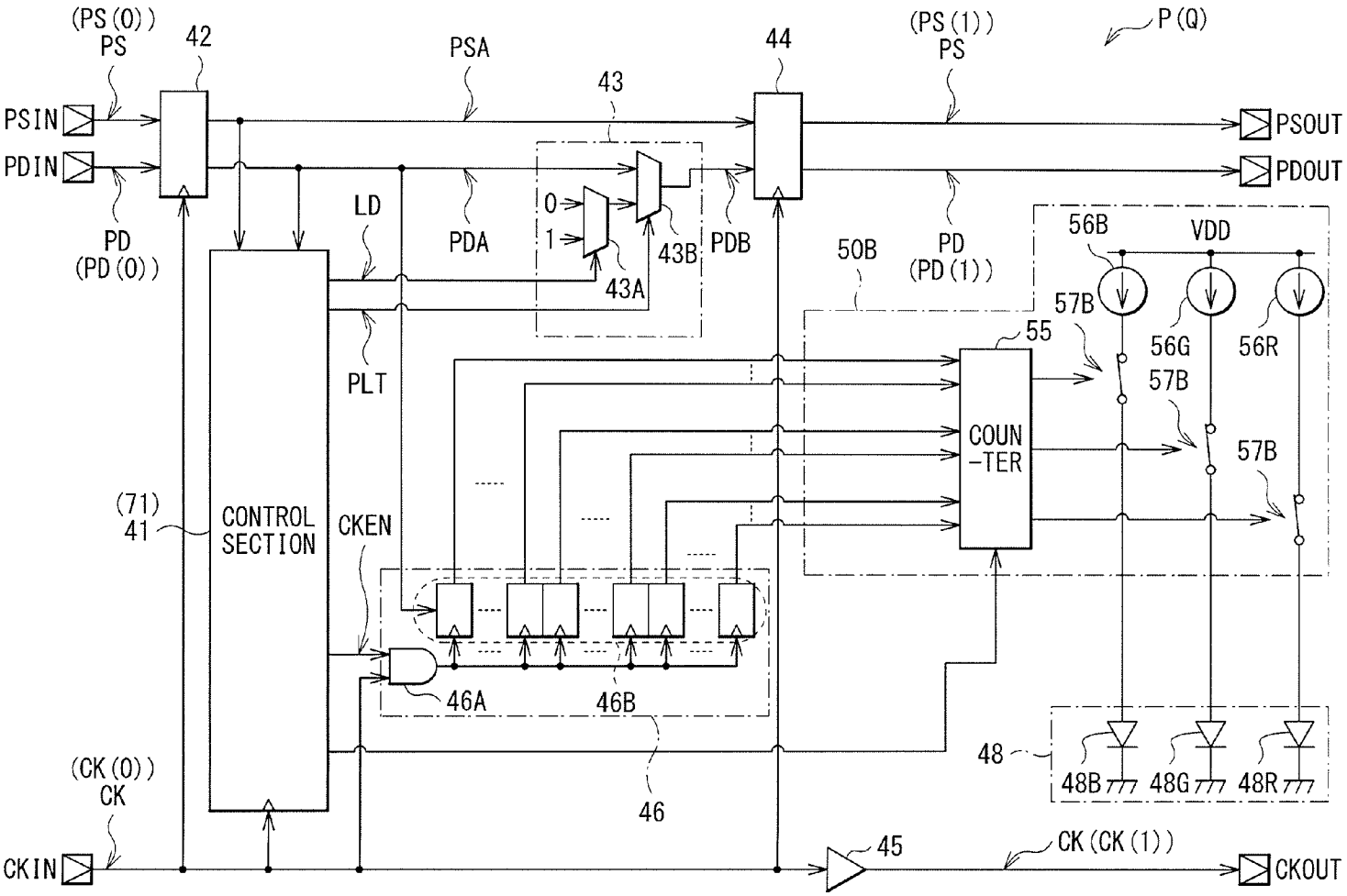
FIG. 3 is a block diagram illustrating a configuration example of a pixel illustrated in FIG. 1.

FIG. 3 illustrates a configuration example of the pixel P. The pixel P includes a control section 41, flip-flops 42 and 44, a selector section 43, a buffer 45, a memory section 46, a drive section 50, and a light emission section 48. It is to be noted that, for convenience of description, description will be given with use of the pixel P(0) in the first stage of the N number of pixels P connected in a daisy chain fashion; however, other pixels P(1) to P(N−1) are similar to the pixel P(0).

The pixel P(0) generates the data signals PS(1) and PD(1) and the clock signal CK(1), based on the data signal PS(0) input to an input terminal PSIN, the data signal PD(0) input to an input terminal PDIN, and the clock signal CK(0) input to an input terminal CKIN. Then, the pixel P(0) outputs the data signal PS(1), the data signal PD(1), and the clock signal CK(1) from an output terminal PSOUT, an output terminal PDOUT, and an output terminal CKOUT, respectively.

The flip-flop 42 is configured to perform sampling of the data signal PS(0), based on the clock signal CK(0) to output a result of the sampling as a data signal PSA, and to perform sampling of the data signal PD(0), based on the clock signal CK(0) to output a result of the sampling as a data signal PDA. The flip-flop 42 may be configured with use of, for example, a D-type flip-flop circuit for sampling of the data signal PS(0) and a D-type flip-flop circuit for sampling of the data signal PD(0).

The control section 41 is a state machine configured to set a state of the pixel P(0), based on the data signals PS(0) and PD(0), and the clock signal CK(0) and generate signals LD, PLT, and CKEN. The signal LD and the signal PLT are signals for rewriting of the variable data VD1 included in the data signal PDA. More specifically, the signal LD is a signal that is converted into the variable data VD1 by the rewriting, and the signal PLT is a control signal indicating a timing of the rewriting. Moreover, the signal CKEN is a control signal indicating a timing of storing the luminance data ID in the memory section 46. Further, the control section 41 also has a function of supplying a control signal to the drive section 50.

The selector section 43 is configured to generate a data signal PDB, based on the data signal PDA and the signals LD and PLT. The selector section 43 includes selectors 43A and 43B. Values "0" and "1" are input to a first input terminal and a second input terminal of the selector 43A, respectively, and the signal LD is input to a control input terminal of the selector 43A. In a case where the signal LD is "0", the selector 43A outputs "0" input to the first input terminal, and in a case where the signal LD is "1", the selector 43A output "1" input to the second input terminal. The data signal PDA and an output signal from the selector 43A are input to a first input terminal and a second input terminal of the selector 43B, respectively, and the signal PLT is input to a control input terminal of the selector 43B. In a case where the signal PLT is "0", the selector 43B outputs the data signal PDA input to the first input terminal, and in a case where the signal PLT is "1", the selector 43B outputs the output signal from the selector 43A input to the second input terminal. The selector section 43 supplies the output signal from the selector 43B as the data signal PDB to the flip-flop 44.

By this configuration, the selector section 43 outputs the data signal PDA without change as the data signal PDB in a period in which the signal PLT is "0", and the selector section 43 outputs the signal LD as the data signal PDB in a period in which the signal PLT is "1". The signal PLT is a signal that is turned to "1" in a period in which the data signal PDA indicates the variable data VD1 and is turned to "0" in other periods. In other words, the selector section 43 generates the data signal PDB by replacing a portion corresponding to the variable data VD1 of the data signal PDA with the signal LD.

The flip-flop 44 is configured to perform sampling of the data signal PSA, based on the clock signal CK(0) to output a result of the sampling as the data signal PS(1) and to perform sampling of the data signal PDB, based on the clock signal CK(0) to output a result of the sampling as the data signal PD(1). The flip-flop 44 may be configured of, for example, two D-type flip-flop circuits, as with the flip-flop 42.

The buffer 45 is configured to perform waveform shaping on the clock signal CK(0) to output the waveform-shaped clock signal CK(0) as the clock signal CK(1).

The memory section 46 is configured to hold the luminance data ID. The memory section 46 includes an AND circuit 46A and a shift register 46B. The AND circuit 46A is configured to determine a logical AND between a signal of a first input terminal thereof and a signal of a second input terminal thereof. The signal CKEN supplied from the control section 41 is input to the first input terminal of the AND circuit 46A, and the clock signal CK(0) is input to the second input terminal of the AND circuit 46. In this example, the shift register 46B is a 36-bit shift register. The data signal PDA is input to a data input terminal of the shift register 46B, and an output signal from the AND circuit 46A is input to a clock input terminal of the shift register 46B.

By this configuration, the memory section 46 holds data included in the data signal PDA in a period in which the signal CKEN is "1". As will be described later, the signal CKEN is a signal that is turned to "1" in a period in which the data signal PDA indicates pixel data ID of 36 bits for the pixel P(0) and is turned to "0" in other periods. Therefore, the AND circuit 46A supplies the clock signal to the shift register 46B in the period in which the data signal PDA indicates the pixel data ID for the pixel P(0). Thus, the shift register 46B holds the pixel data ID of 36 bits for the pixel P(0). At this time, a portion of last 12 bits of the shift register 46B holds the luminance data IDR, a middle portion of 12 bits of the shift register 46B holds the luminance data IDG, and a portion of first 12 bits of the shift register 36B holds the luminance data IDB.

The drive section 50 is configured to drive the light emission section 48, based on the luminance data ID stored in the memory section 46. The drive section 50 includes a counter 55, current sources 56R, 56G, and 56B, and switches 57R, 57G, and 57B.

The counter 55 is configured to generate pulse signals with pulse widths according to the luminance data IDR, IDG, and IDB stored in the memory section 46 by counting clock pulses of a control signal (a clock signal for counter) supplied from the control section 41 with use of the control signal as a reference. More specifically, the counter 55 may be configured so as to include, for example, count comparison circuits 51R, 51G, and 51B (not illustrated). The count comparison circuit 51R is configured to generate a pulse signal with a pulse width according to the luminance data IDR by comparing a count value of the clock pulses to a count value corresponding to the luminance data IDR. The count comparison circuits 51G and 51B are similar to the count comparison circuit 51R.

Each of the current sources 56R, 56G, and 56B is configured to generate a certain drive circuit. The switches 57R, 57G, and 57B are configured to be turned on or off in response to a pulse signal supplied from the counter 55.

The light emission section 48 is configured to emit light, based on a drive current supplied from the drive section 50. The light emission section 48 includes light-emitting devices 48R, 48G, and 48B. Each of the light-emitting devices 48R, 48G, and 48B is a light-emitting device configured with use of an LED, and the light-emitting devices 48R, 48G, and 48B are configured to emit light of red (R), green (G), and blue (B), respectively.

By this configuration, first, the counter 55 generates the pulse signals with pulse widths according to the luminance data IDR, IDG, and IDB stored in the memory section 46. Then, the switch 57R is turned on or off in response to the pulse signal with the pulse width according to the luminance data IDR to supply the drive current generated by the current source 56R to the light-emitting device 48R. The light-emitting device 48R emits light, based on the drive current. Likewise, the switch 57G is turned on or off in response to the pulse signal with the pulse width according to the luminance data IDG to supply the drive current generated by the current source 56G to the light-emitting device 48G, and the light-emitting device 48G emits light, based on the drive current. Moreover, the switch 57B is turned on or off in response to the pulse signal with the pulse width according to the luminance data IDB to supply the drive current generated by the current source 56B to the light-emitting device 48B, and the light-emitting device 48B emits light, based on the drive current. Thus, each of the light-emitting devices 48R, 48G, and 48B emits light with light emission luminance (luminance×time) according to a duration in which light is emitted.

The pixel P corresponds to a specific example of "unit pixel" in an embodiment of the present disclosure. The pixel packet PCT1 in which the flag EM is "0" corresponds to a specific example of "first pixel packet" in an embodiment of the present disclosure. The pixel packet PCT1 in which the flag EM is "1" corresponds to a specific example of "second pixel packet" in an embodiment of the present disclosure. The variable data VD1 corresponds to a specific example of "first variable data" in an embodiment of the present disclosure.

[Operation and Functions]

Next, an operation and functions of the display panel 1 according to this embodiment will be described below.

(Outline of Entire Operation)

First, an outline of an entire operation of the display panel 1 will be described below referring to FIG. 1 and the like. The display drive section 10 controls light emission in each pixel P of the display section 20, based on the image signal Sdisp. More specifically, the display drive section 10 supplies the data signal PS and PD and the clock signal CK to each pixel column of the pixels P in the display section 20. Each pixel P receives the data signals PS and PD and the clock signal CK from the pixel P previous thereto, and generates new data signals PS and PD and a new clock signal CK, based on these received signals to supply the generated signals to the pixel P subsequent thereto. In a case where the flag EM in each pixel packet PCT1 is "0", each pixel P reads the variable data VD1 in the pixel packet PCT1. Then, each pixel P decrements the value of the variable data VD1, and reads the luminance data ID in the pixel packet PCT1 in a case where the value of the variable data VD1 is "0". Moreover, in a case where the flag EM is "1", each pixel P emits light with light emission luminance according to the luminance data ID that has been already read.

Next, an operation of reading the luminance data ID in the pixel P and a light emission operation of the pixel P will be described in detail below.

(Operation of Reading Luminance Data ID)

Figure 4:
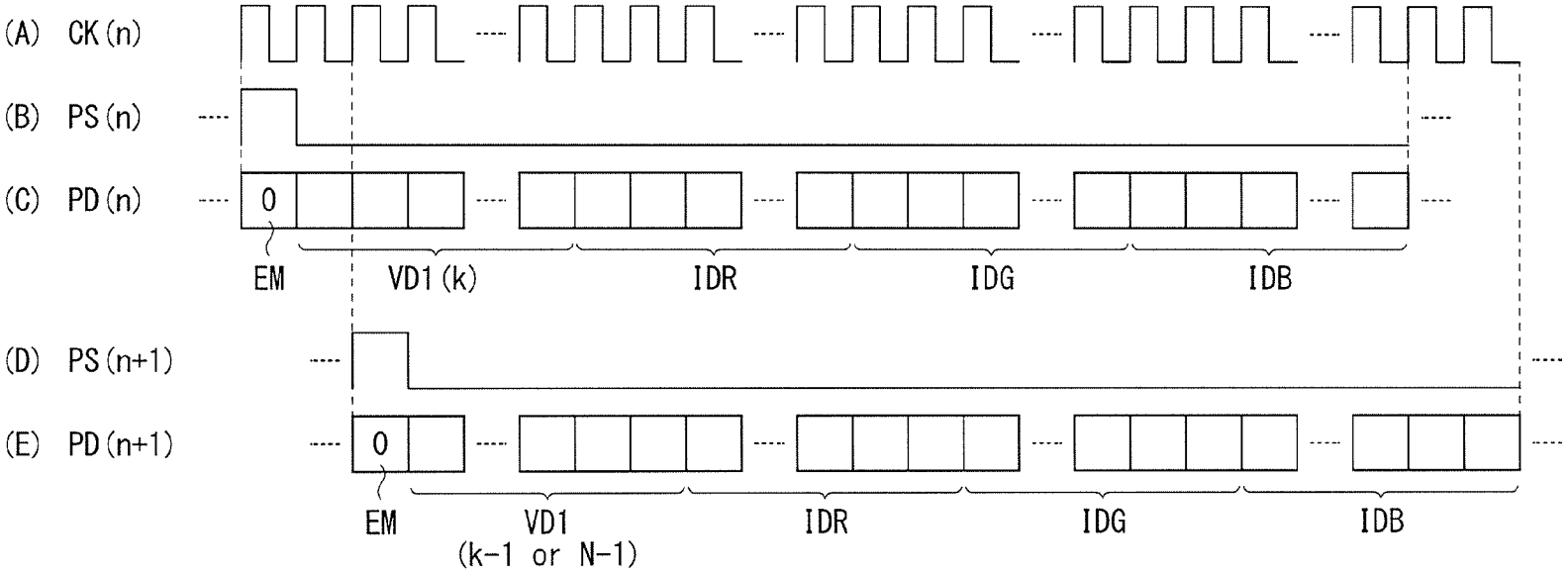
FIG. 4 is an explanatory diagram illustrating an operation example of the pixel illustrated in FIG. 3.

FIG. 4 illustrates an operation of reading the luminance data ID in an nth pixel P(n), and parts (A) to (C) indicate the clock signal CK(n) and the data signals PS(n) and PD(n) input to the pixel P(n), respectively, and parts (D) and (E) indicate data signals PS(n+1) and PD(n+1) output from the pixel P(n), respectively.

A pixel P(n−1) previous to the pixel P(n) supplies, to the pixel P(n), the data signal PD(n) (the pixel packet PCT1) configured of the flag EM indicating "0", the variable data VD1 indicating a value "k", and the luminance data IDR, IDG, and IDB together with the data signal PS(n) and the clock signal CK(n) (refer to the parts (A) to (C) in FIG. 4).

The control section 41 of the pixel P(n) acquires, as the flag EM, the data signal PD(n) when the data signal PS(n) is turned to "1". In this example, the flag EM is "0"; therefore, the control section 41 acquires the value "k" of the variable data VD1 from the data signal PD(n). Then, the control section 41 supplies the signals LD and PLT to the selector section 43, and the selector section 43 changes the value "k" of the variable data VD1 in the data signal PDA (refer to FIG. 3) into a decremented value "k−1" to generate the data signal PDB. At this time, in a case where the value "k" of the variable data VD1 is "0", as a result of decrementing the value, the value is changed to "N−1" by wrap processing.

Moreover, in a case where the value "k" of the variable data VD1 is "0", the control section 41 supplies the signal CKEN to the memory section 46, and the memory section 46 reads the luminance data IDR, IDG, and IDB in the data signal PDA. It is to be noted that, in this example, the control section 41 replaces only a portion corresponding to the variable data VD1 of the data signal PDA with the signal LD; however, this embodiment is not limited thereto, and alternatively, for example, portions corresponding to the variable data VD1 and the luminance data IDR, IDG, and IDB may be replaced with the signal LD. More specifically, for example, all of the luminance data IDR, IDG, and IDB may be replaced with "0". In this case, in the pixels P subsequent to the pixel P(n), the number of transitions of the data signal PD is allowed to be reduced, and power consumption is allowed to be reduced.

Then, the pixel P(n) generates the data signal PD(n+1) in such a manner, and outputs the data signal PD(n+1) together with the data signal PS(n+1) (refer to the parts (D) and (E) in FIG. 4). At this time, as illustrated in FIG. 3, the pixel P(n) includes two flip-flops 42 and 44; therefore, the data signals PS(n+1) and PD(n+1) are delayed from the data signals PS(n) and PD(n) by two clocks. It is to be noted that the amount of delay is based on the configuration of the pixel P(n); therefore, in a case where the pixel P(n) has a configuration different from the configuration in FIG. 3, the amount of delay may be 1 clock or 3 or more clocks.

Next, as a more specific example, a case where a second pixel P(2) reads the luminance data ID will be described below. It is to be noted that, in this example, for convenience of description, four pixels P(0) to P(3) are connected in a daisy chain fashion. In other words, in this example, N equals to 4.

Figure 5A:
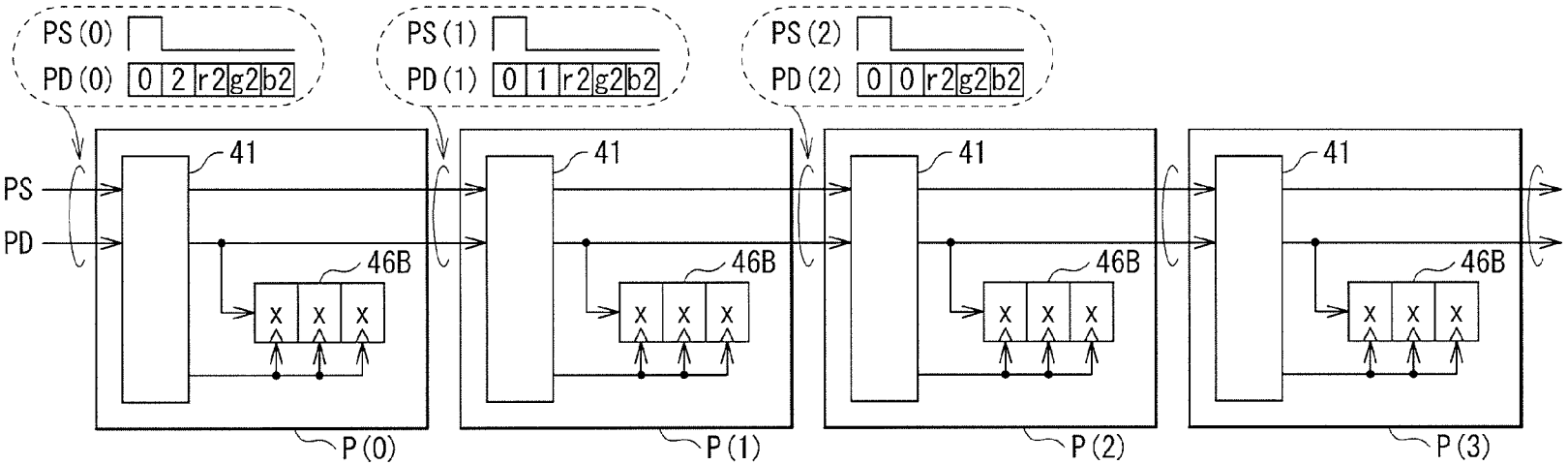
FIG. 5A is an explanatory diagram illustrating an operation example of the display panel illustrated in FIG. 1.
Figure 5B:
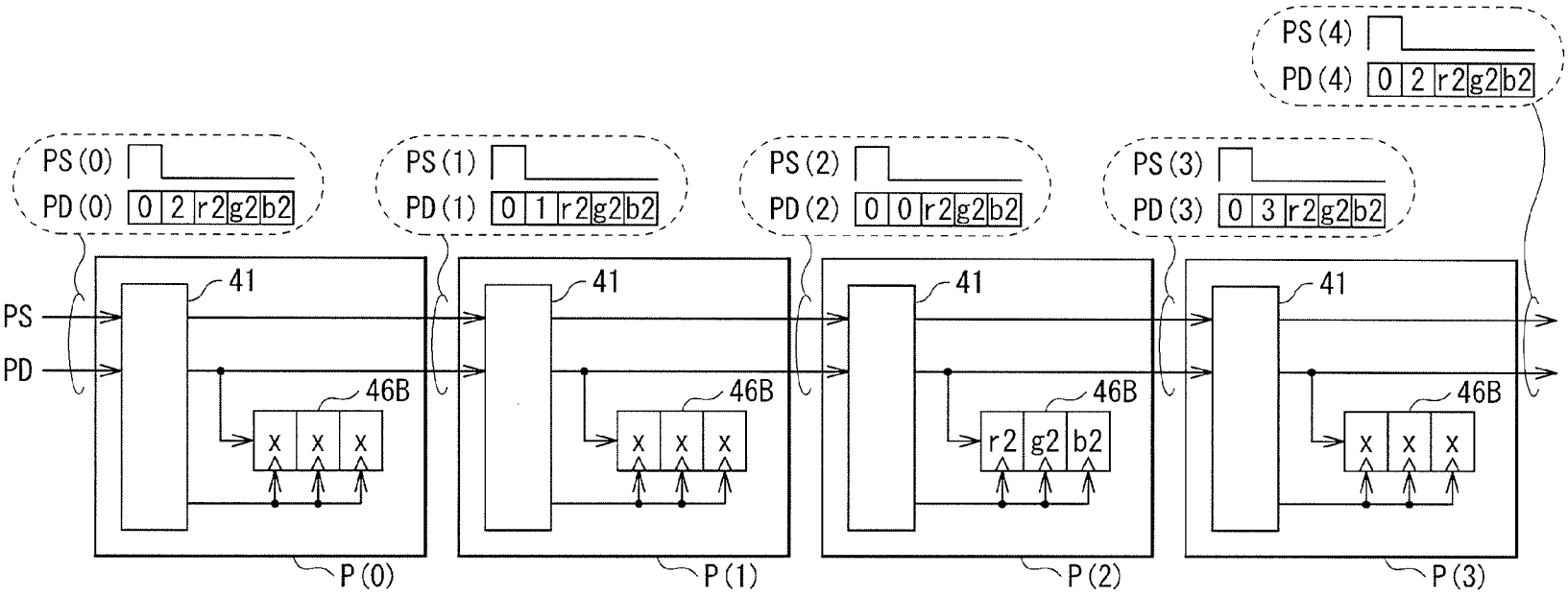
FIG. 5B is an explanatory diagram illustrating the operation example of the display panel illustrated in FIG. 1.

FIGS. 5A and 5B illustrate an operation of reading the luminance data ID in the pixel P(0) to P(3). The data signals PS and PD input to the pixels P(0) to P(3) are illustrated in upper portions of these diagrams. Five frames of the data signal PD (the pixel packet PCT1) indicate the flag EM, the variable data VD1, the luminance data IDR, IDG, and IDB in this order from the left. Moreover, simplified block diagrams of the pixels P(0) to P(3) are illustrated in lower portions of these diagrams.

The display drive section 10 generates the data signal PD(0) configured of the flag EM indicating "0", the variable data VD1 indicating "2", and the luminance data IDR, IDG, and IDB indicating values "r2, "g2", and "b2", respectively, and supplies this data signal PD(0) to the pixel P(0) in a first stage together with the data signal PS(0) and the clock signal CK(0) (refer to FIG. 5A). In other words, the display drive section 10 sets the variable data VD1 to "2" to allow the second pixel P(2) to read the luminance data IDR, IDG, and IDB ("r2", "g2", and "b2"). The pixel P(0) decrements the value "2" of the variable data VD1 included in the data signal PD(0) to generate the data signal PD(1) in which the value of the variable data VD1 is "1", and then outputs the data signal PD(1) together with the data signal PS(1). Likewise, the pixel P(1) decrements the value "1" of the variable data VD1 included in the data signal PD(1) to generate the data signal PD(2) in which the value of the variable data VD1 is "0", and then outputs the data signal PD(2) together with the data signal PS(2).

Next, since the value of the variable data VD1 included in the data signal PD(2) is "0", the pixel P(2) changes the value of the variable data VD1 to "3" (=N−1), and reads the values 2r, g2, and b2 of the luminance data IDR, IDG, and IDB (refer to FIG. 5B). Then, the pixel P(2) outputs the data signal PD(3) in which the value of the variable data VD1 is "3" together with the data signal PS(3). Then, the pixel P(3) decrements the value "3" of the variable data VD1 included in the data signal PD(3) to generate the data signal PD(4) in which the value of the variable data VD1 is "2", and outputs the data signal PD(4) together with the data signal PS(4).

Thus, in the display panel 1, the pixel packet PCT1 including the variable data VD1 is transmitted, and each pixel P determines, based on the variable data VD1, whether or not to read the luminance data ID; therefore, the luminance data ID of an arbitrary pixel P of the N number of pixels P connected in a daisy chain fashion is allowed to be rewritten.

Moreover, in the display panel 1, in a case where the value of the variable data VD1 included in the pixel packet PCT1 is "0", the pixel P reads the luminance data IDR, IDG, and IDB, and changes the value of the variable data VD1 into a value "N−1" obtained by subtracting 1 from "N" as the number of pixels P connected in a daisy chain fashion by wrap processing; therefore, a possibility that a plurality of pixels P read the luminance data IDR, IDG, and IDB of a same pixel packet PCT1 is allowed to be reduced.

(Light Emission Operation)

Figure 6:
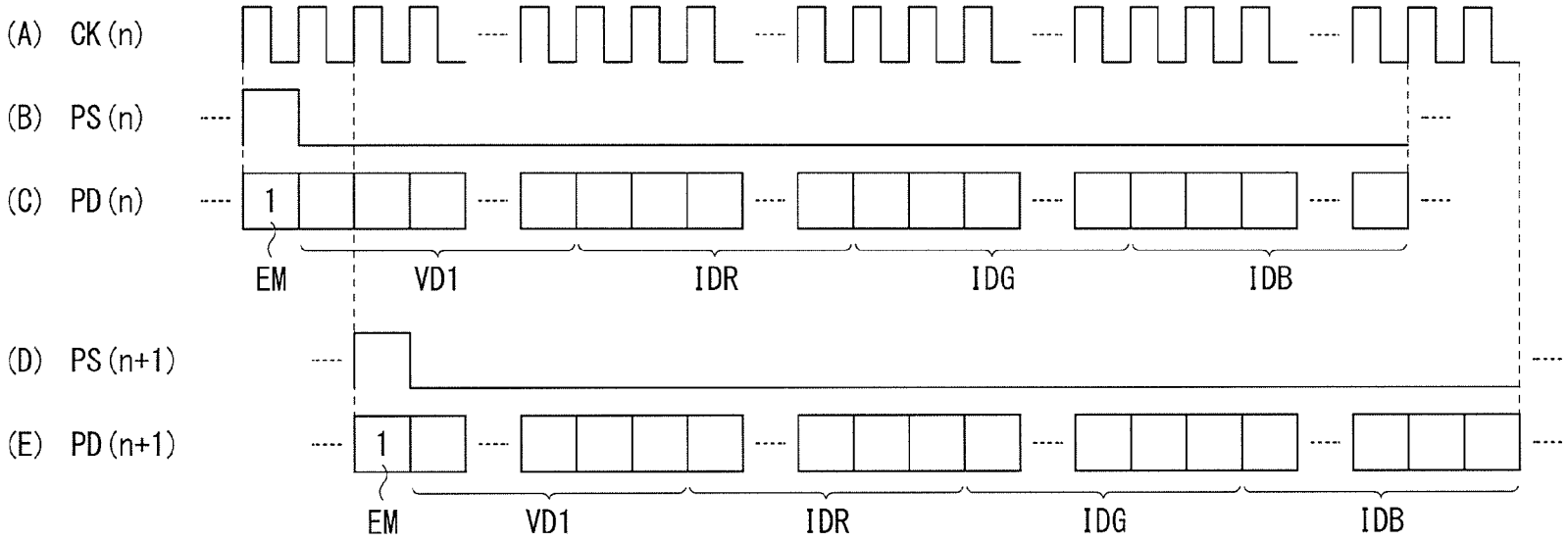
FIG. 6 is an explanatory diagram illustrating another operation example of the pixel illustrated in FIG. 3.
Figure 7A:
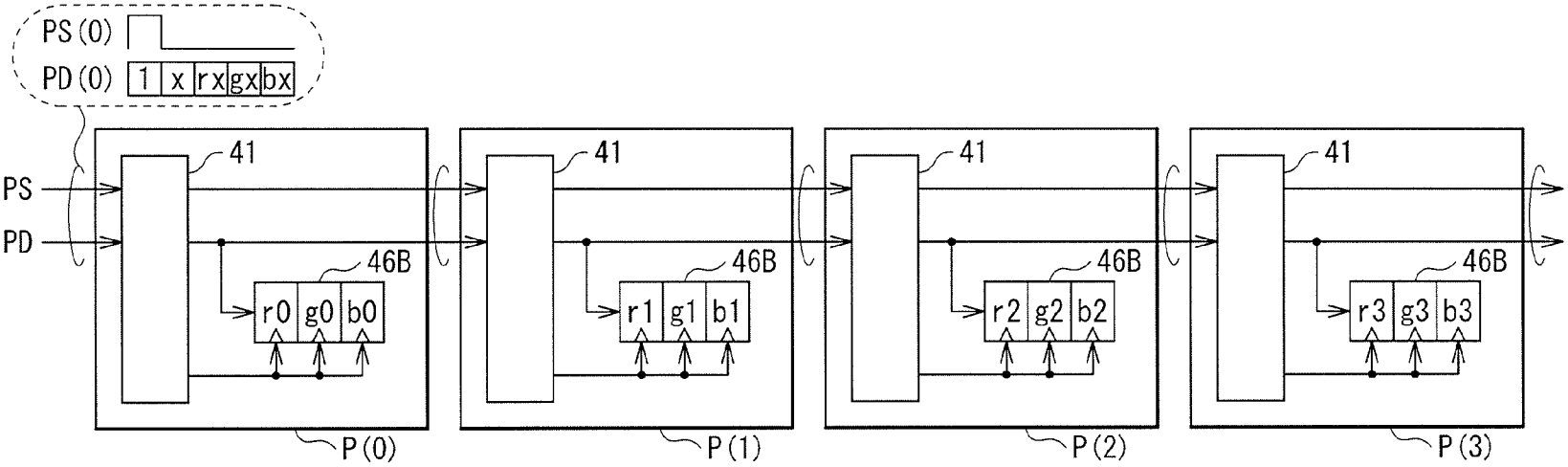
FIG. 7A is an explanatory diagram illustrating another operation example of the display panel illustrated in FIG. 1.
Figure 7B:
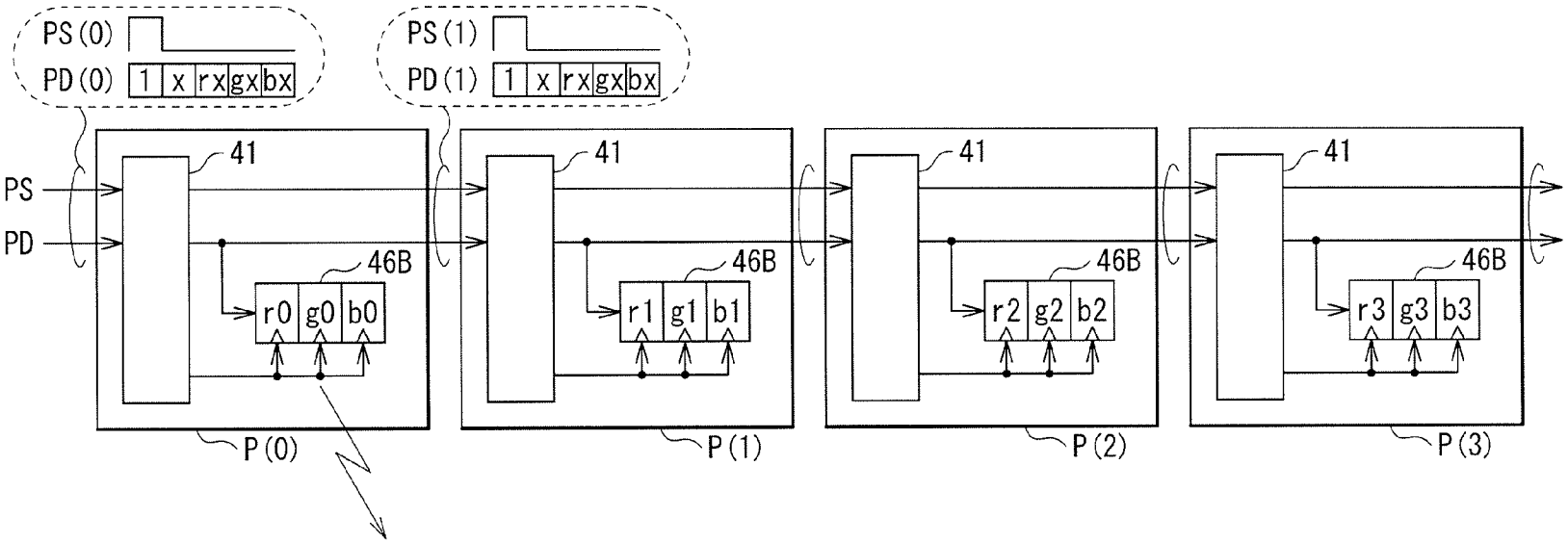
FIG. 7B is an explanatory diagram illustrating the another operation example of the display panel illustrated in FIG. 1.
Figure 7C:
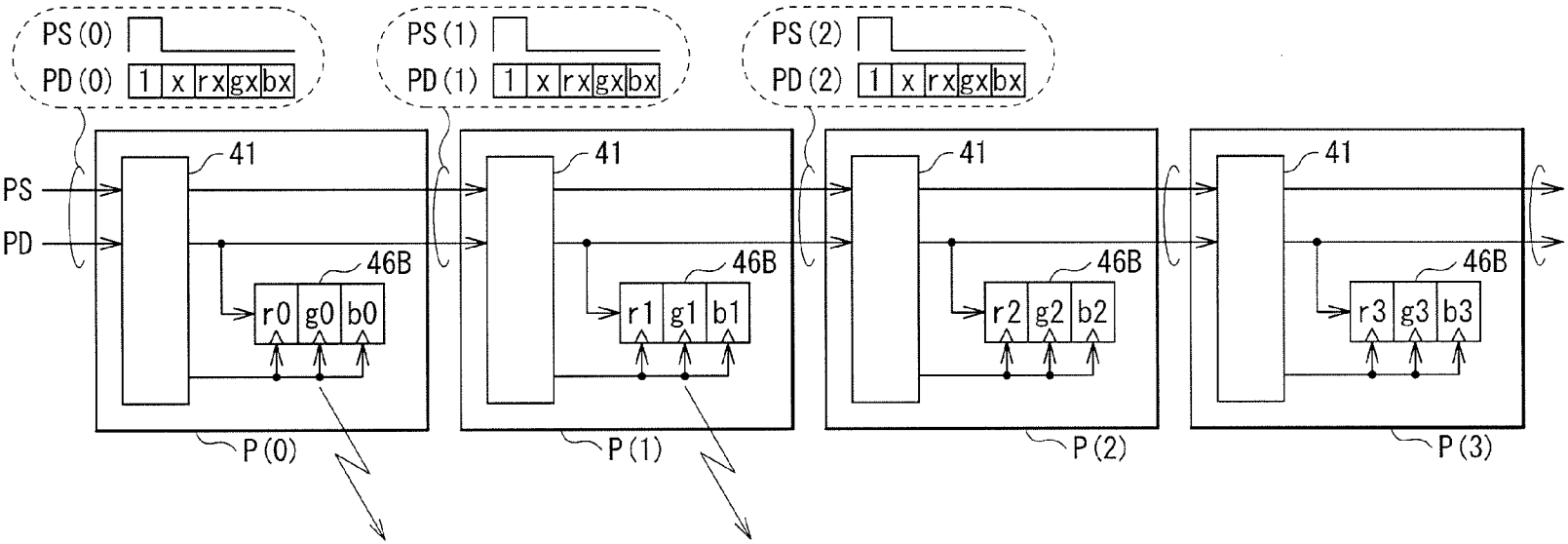
FIG. 7C is an explanatory diagram illustrating the another operation example of the display panel illustrated in FIG. 1.
Figure 7D:
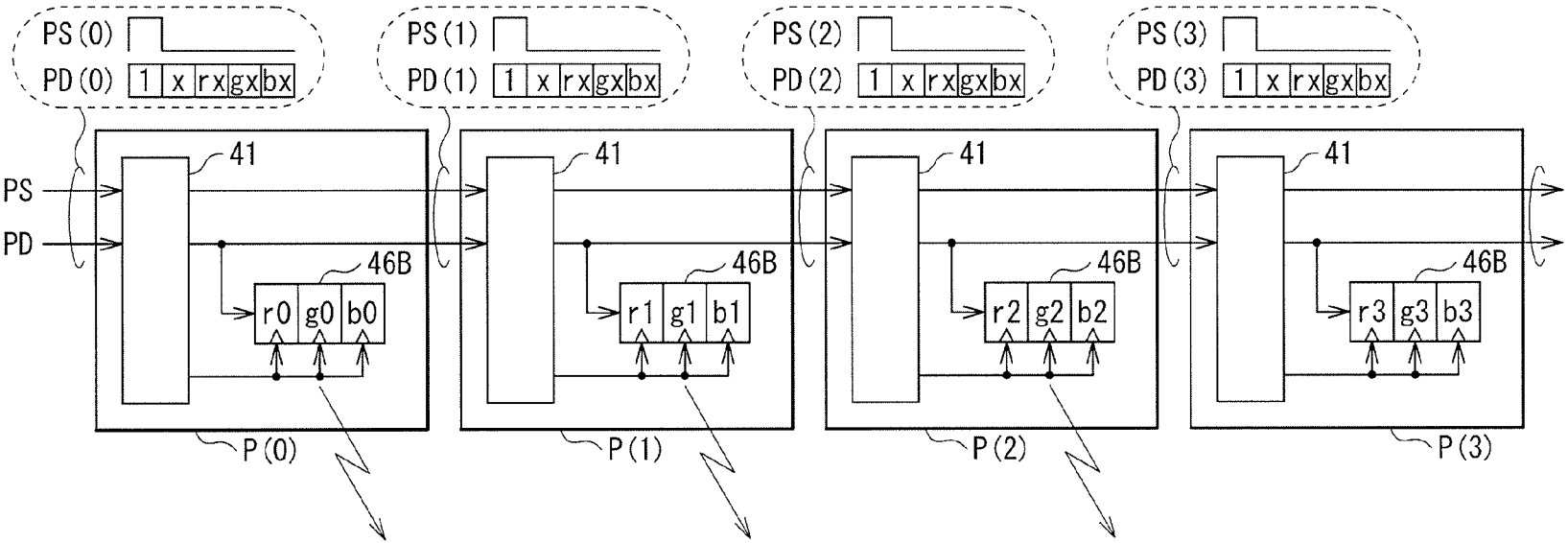
FIG. 7D is an explanatory diagram illustrating the another operation example of the display panel illustrated in FIG. 1.
Figure 7E:
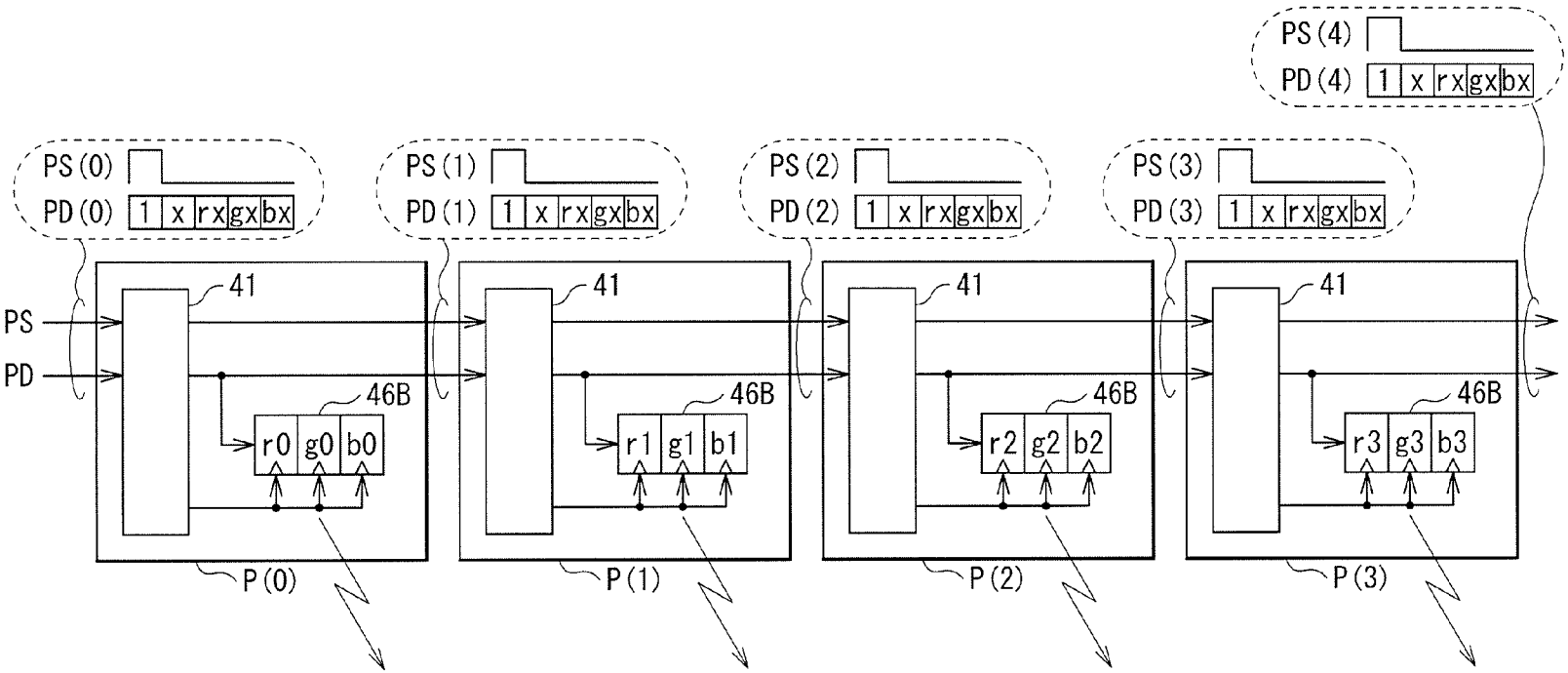
FIG. 7E is an explanatory diagram illustrating the another operation example of the display panel illustrated in FIG. 1.

FIG. 6 illustrates a light emission operation in the nth pixel P(n), and parts (A) to (C) in FIG. 6 indicate the clock signal CK(n) and the data signal PS(n) and PD(n) input to the pixel P(n), respectively, and parts (D) and (E) in FIG. 6 indicate the data signal PS(n+1) and PD(n+1) output from the pixel P(n), respectively.

The pixel P(n−1) previous to the pixel P(n) supplies, to the pixel P(n), the data signal PD(n) (the pixel packet PCT1) configured of the flag EM indicating "1", the variable data VD1, and the luminance data IDR, IDG, and IDB together with the data signal PS(n) and the clock signal CK(n) (refer to the parts (A) to (C) in FIG. 6). In this case, each of the variable data VD1 and the luminance data ID may have an arbitrary value. More specifically, for example, both the variable data VD1 and the luminance data ID may be "0". In this case, the number of transitions of the data signal PD in the N number of pixels P connected in a daisy chain fashion is allowed to be reduced, and power consumption is allowed to be reduced.

The control section 41 of the pixel P(n) acquires, as the flag EM, the data signal PD(n) when the data signal PS(n) is turned to "1". In this example, the flag EM is "1"; therefore, the control section 41 supplies a control signal (the clock signal for counter) to the counter 55 of the drive section 50. The counter 55 generates pulse signals with pulse widths according to the luminance data IDR, IDG, and IDB. Then, the light-emitting devices 48R, 48G, and 48B emit light with light emission luminance according to these pulse widths.

Then, the pixel P(n) delays the data signals PS(n) and PD(n) by 2 clocks without change, and outputs the delayed data signals PS(n) and PD(n) as the data signals PS(n+1) and PD(n+1) (refer to the parts (D) and (E) in FIG. 6).

Next, as a more specific example, a light emission operation in a case where four pixels P(0) to P(3) are connected in a daisy chain fashion will be described below.

FIGS. 7A to 7E illustrate light emission operations in the pixels P(0) to P(3). The display drive section 10 generates the data signal PD(0) configured of the flag EM indicating "1", the variable data VD1 indicating an arbitrary value "x", and the luminance data IDR, IDG, and IDB indicating arbitrary values "rx", "gx", and "bx", respectively, and supplies the data signal PD(0) to the pixel P(0) in the first stage together with the data signal PS(0) and the clock signal CK(0) (refer to FIG. 7A). The pixel P(0) emits light with luminance according to the luminance data IDR, IDG, and IDB ("r0", "g0", and "b0") that have been already read, and outputs the data signal PS(0) and PD(0) without change as the data signal PS(1) and PD(1), respectively, (refer to FIG. 7B). Likewise, the pixels P(1) to P(3) sequentially emit light, and output the data signals PS and PD (refer to FIGS. 7C to 7E).

Thus, in the display panel 1, the pixel packet PCT1 with a same configuration is used in the operation of reading the luminance data ID and the light emission operation; therefore, a circuit operation is allowed to be simplified.

In the display panel 1, the pixels P are connected in a daisy chain fashion. Therefore, each pixel P receives the data signals PS and PD and the clock signal CK from the pixel P previous thereto, and generates new data signals PS and PD and a new clock signal CK, based on these received signals to supply the generated signals to the pixel P subsequent thereto. Then, each pixel P reads the luminance data ID for the pixel P from the data signal PD, and emits light with light emission luminance according to the luminance data ID. Thus, in the display panel 1, the pixels P are connected in a daisy chain fashion; therefore, image quality is allowed to be enhanced.

In other words, for example, in a display panel described in Japanese Unexamined Patent Application Publication No. 2012-32828, a drive section drives each pixel through a gate line or a data line. The gate line or the data line is so-called global wiring connected to a plurality of pixels belonging to one pixel column or a plurality of pixels belonging to one pixel row. Therefore, for example, to achieve a large-screen display panel, lengths of these wiring lines are increased; therefore, resistance or parasitic capacity of the wiring lines may be increased, and each pixel may not be allowed to be sufficiently driven accordingly. Moreover, for example, to achieve a high-definition display panel, it is necessary to drive a larger number of lines in each frame period; therefore, time assigned to one horizontal period (1 H) may be reduced, and each pixel may not be allowed to be sufficiently driven accordingly. Further, for example, to increase a frame rate, time assigned to one horizontal period (1 H) may be reduced, and each pixel may not be allowed to be sufficiently driven accordingly.

On the other hand, in the display panel 1 according to this embodiment, the pixels are connected in a daisy chain fashion. In other words, each pixel P drives the pixel P subsequent thereto not through the above-described global wiring but through local wiring between the pixels. Therefore, each pixel P is allowed to drive the pixel P subsequent thereto relatively easily through such short wiring, and a large-screen display panel is allowed to be achieved. Moreover, since the wiring is short, each pixel P is allowed to increase transfer speed of the data signals PS, PD, and the like relatively easily, and a high-definition display panel or a display panel with a high frame rate is allowed to be achieved.

Moreover, since the pixels P are connected in a daisy chain fashion in such a manner, the configuration of the display panel 1 is allowed to be simplified. In other words, in the display panel described in Japanese Unexamined Patent Application Publication No. 2012-32828, a plurality of gate lines extending along a horizontal direction, a plurality of data lines extending along a vertical direction, a so-called gate driver connected to the gate lines, and a so-called data driver connected to the data lines are provided; therefore, the configuration of the display panel may be complicated. On the other hand, in the display panel 1 according to this embodiment, the pixels P are connected in a daisy chain fashion; therefore, as illustrated in FIG. 1, it is only necessary to provide wiring between the pixels P extending along the vertical direction and the display drive section 20. Therefore, it is not necessary to provide wiring extending along the horizontal direction and a drive section for driving of the wiring, and the configuration of the display panel 1 is allowed to be simplified.

Moreover, in the display panel 1, light emission of each pixel P is controlled with use of a digital signal (the data signals PS and PD and the clock signal CK); therefore, an influence of noise on image quality is allowed to be reduced. For example, in the display panel in Japanese Unexamined Patent Application Publication No. 2012-32828, an analog signal is used; therefore, noise may cause deterioration in image quality. Moreover, specifically in the large-screen display panel, the high-definition display panel, and the display panel with a high frame rate, the influence of noise on image quality may be further increased. On the other hand, in the display panel 1 according to this embodiment, the digital signal is used; therefore, the influence of noise on image quality is allowed to be reduced.

Further, since the digital signals are used in such a manner, radiation is allowed to be reduced. In other words, for example, in a case where an analog signal is used, in terms of gradation expression, resistance to noise, and the like, signal amplitude may be increased, and in this case, radiation may be increased. On the other hand, in the display panel 1 according to this embodiment, the digital signal is used; therefore, the signal amplitude is allowed to be reduced, thereby reducing radiation.

Furthermore, in the display panel 1, each pixel P includes the flip-flops 42 and 44 and the buffer 45; therefore, signal amplitudes of the data signals PS and PD and the like are allowed to be reduced. In other words, in a case where the flip-flops 42 and 44 and the buffer 45 are not provided, the signal amplitude may be attenuated with an increasing distance from the display drive section. In this case, it is necessary for the display drive section to generate the data signals PS and PD with a large signal amplitude. On the other hand, in the display panel 1, the signal amplitude is maintained by performing waveform shaping on the data signals PS and PD and the clock signal CK every time these signals pass through the pixel P. In other words, a possibility that the signal amplitude is attenuated is allowed to be reduced; therefore, the signal amplitudes of the data signals PS and PD are allowed to be reduced. Therefore, while the above-described radiation is allowed to be reduced, a power supply voltage is allowed to be reduced, and power consumption is allowed to be reduced.

Moreover, in the display panel 1, since the memory section 46 is provided to each pixel P, for example, in a case where a still image is displayed, it is not necessary to perform data transfer, and power consumption is allowed to be reduced accordingly.

Further, in the display panel 1, since the flip-flops 42 and 44 that perform sampling of the data signal PS and PD, based on the clock signal CK are provided to each pixel, a relative phase relationship between the data signals PS and PD and the clock signal CK is allowed to be maintained.

Furthermore, in the display panel 1, the pixel packet PCT1 including the variable data VD1 is transmitted, and each pixel P determines, based on the variable data VD1, whether or not to read the luminance data ID; therefore, the luminance data ID of an arbitrary pixel P is allowed to be rewritten, and flexibility of an display operation is allowed to be enhanced. Accordingly, in a case where only a part of a display image is changed, it is only necessary to rewrite only luminance data ID of pixels P corresponding to the changed part; therefore, power consumption is allowed to be reduced. In other words, it is not necessary to rewrite the luminance data ID of the pixels P of which the luminance data ID is not changed, and it is only necessary to transmit only the pixel packet PCT1 for the pixel P in which it is necessary to rewrite the luminance data ID; therefore, time to transmit the pixel packet PCT1 is allowed to be reduced, and power consumption is allowed to be reduced.

In addition, in the display panel 1, the pixel packet PCT1 including the variable data VD1 is transmitted, and each pixel P changes the variable data VD1; therefore, a simple configuration is allowed to be achieved. In other words, for example, in a case where an address is provided to each pixel P, and the pixel packet PCT1 includes the address of the pixel P that is to read the luminance data ID, it is necessary to provide a memory for holding the address to each pixel P, or it is necessary to perform a control operation to provide an address to each pixel P; therefore, the configuration may be complicated. On the other hand, in the display panel 1, each pixel P changes the variable data VD1 of the pixel packet PCT1, and in a case where the value of the variable data VD1 is "0", the pixel P reads the luminance data ID; therefore, it is not necessary for each pixel P to hold the address; therefore, a simple configuration is allowed to be achieved.

[Effects]

As described above, in this embodiment, the pixel packet including the variable data is transmitted, and each pixel determines, based on the variable data, whether or not to read the luminance data; therefore, the luminance data of an arbitrary pixel is allowed to be rewritten, thereby enhancing flexibility of the display operation. Thus, for example, in a case where only a part of the display image is changed, it is only necessary to rewrite luminance data of pixels corresponding to the changed part; therefore, power consumption is allowed to be reduced.

Moreover, in this embodiment, the pixel packet including the variable data is transmitted, and each pixel changes the variable data; therefore, a simple configuration is allowed to be achieved.

MODIFICATION EXAMPLE 1-1

Figure 8:
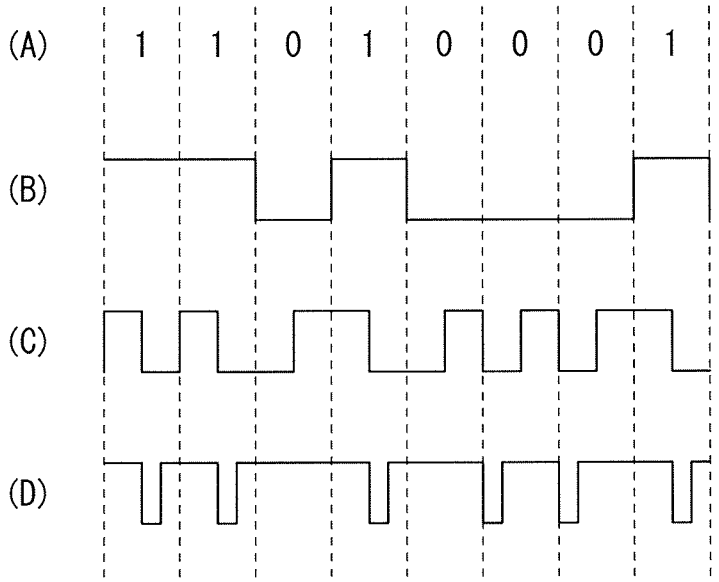
FIG. 8 is a waveform diagram illustrating a configuration example of a data signal according to a modification example.

In the above-described embodiment, the data signal PD is a signal encoded by NRZ encoding as illustrated in a part (B) in FIG. 8; however, the data signal PD is not limited thereto. Alternatively, for example, the data signal PD may be a signal encoded by Manchester encoding as illustrated in a part (C) in FIG. 8, or may be a signal encoded by modified Miller encoding as illustrated in a part (D) in FIG. 8. Each of the signals in the parts (B) to (D) in FIG. 8 is a signal obtained by encoding a data stream illustrated in a part (A) in FIG. 8.

MODIFICATION EXAMPLE 1-2

In the above-described embodiment, the drive section 50 is configured with use of the counter 55; however, the drive section 50 is not limited thereto. Alternatively, the drive section may be configured with use of, for example, a DAC (Digital-to-Analog Converter). A pixel PB according to this modification example will be described in detail below.

Figure 9:
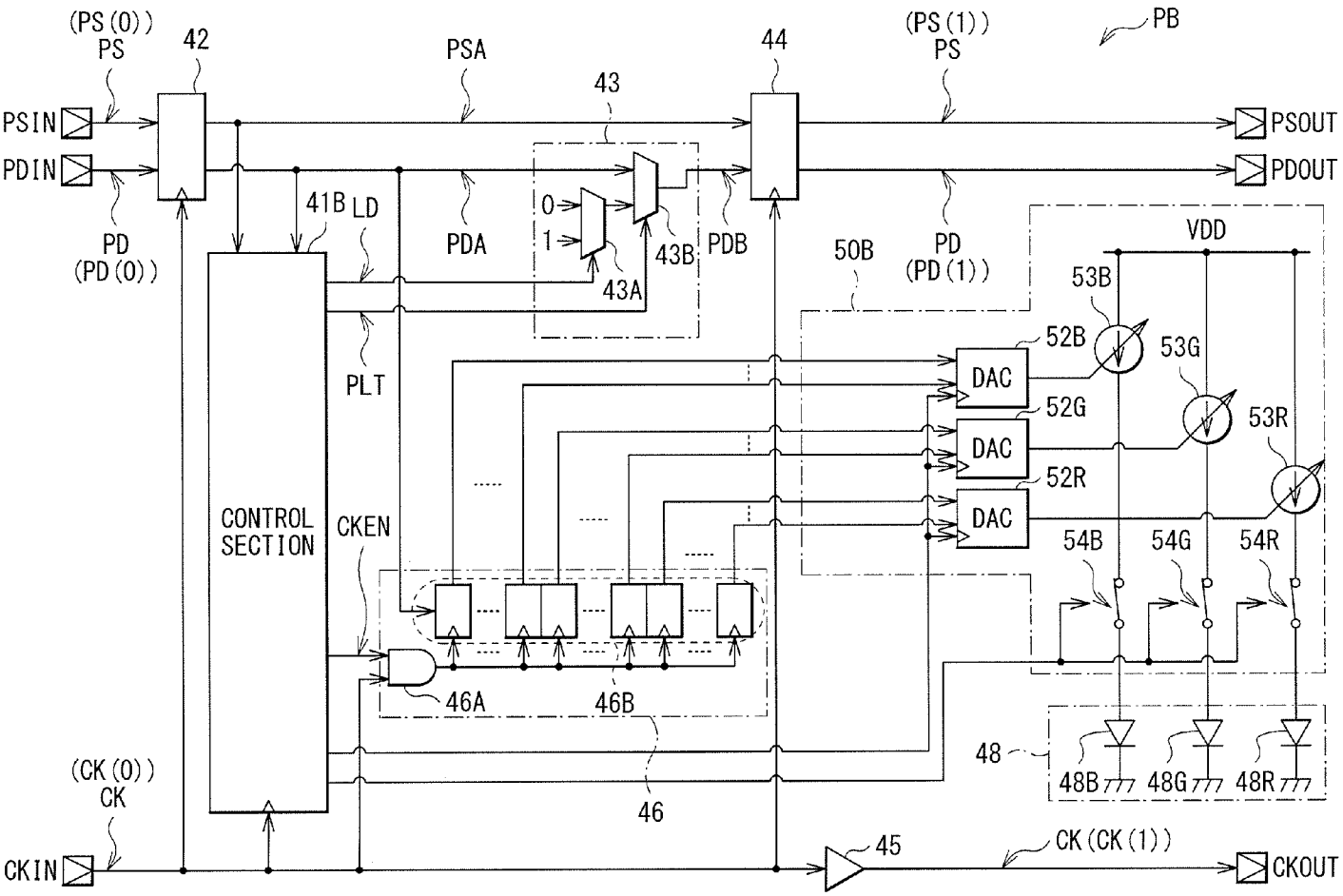
FIG. 9 is a block diagram illustrating a configuration example of a pixel according to a modification example.

FIG. 9 illustrates a configuration example of the pixel PB. The pixel PB includes a control section 41B and a drive section 50B. The control section 41B has a function similar to that of the control section 41 according to the above-described embodiment, and the control section 41B is configured to function as a state machine, and to supply a control signal to the drive section 50B. The drive section 50B includes DACs 52R, 52G, and 52B, and variable current sources 53R, 53G, and 53B. The DACs 52R, 52G, and 52B convert the luminance data IDR, IDG, and IDB (digital codes) into analog voltages, respectively, based on a control signal supplied from the control section 41B. The variable current sources 53R, 53G, and 53B are configured to generate drive currents according to analog voltages supplied from the DACs 52R, 52G, and 52B, respectively.

By this configuration, for example, the DAC 52R generates an analog voltage, based on the luminance data IDR. Then, the variable current source 53R generates a drive current, based on the analog voltage, and supplies the drive current to the light-emitting device 48R of the light emission section 48 through the switch 54R. The light-emitting device 48R emits light with light emission luminance according to the drive current. Therefore, the pixel PB is allowed to change light emission luminance (luminance×time) by changing luminance I. In other words, while the pixel P according to the above-described embodiment changes light emission luminance (luminance×time) by changing a duration in which light is emitted, the pixel PB according to this modification example is allowed to change light emission luminance (luminance×time) by changing luminance I.

It is to be noted that the switches 54R, 54G, and 54B are configured to be subjected to ON/OFF control by a control signal supplied from the control section 41B; therefore, in the pixel PB, light emission luminance is allowed to be adjusted while maintaining balance of light emission luminance of red (R), green (G), and blue (B).

MODIFICATION EXAMPLE 1-3

In the above-described embodiment, each pixel P decrements the value of the variable data VD1; however, the pixel P is not limited thereto. Alternatively, for example, each pixel P may increment the value of the variable data VD1. More specifically, for example, the display drive section 10 allows a kth pixel P(k) to read the luminance data IDR, IDG, and IDB; therefore, the variable data VD1 is set to "N−k". A 0th pixel P(0) increments the value of the variable data VD1 to set the variable data VD1 to "N−k+1". The pixels P(1) to P(k−2) increment the value of the variable data VD1 in a similar manner. Then, a (k−1)th pixel P(k−1) increments a value "N−1" of the variable data VD1. As a result, the value of the variable data VD1 output from the pixel P(k−1) is incremented to be changed into "0" by wrap processing. Then, since the value of the variable data VD1 is "0", the kth pixel p(k) reads the luminance data IDR, IDG, and IDB.

(2. Second Embodiment)

Next, a display panel 2 according to a second embodiment will be described below. In this embodiment, a pixel packet different from the pixel packet PCT1 used in the operation of reading the luminance data ID is used in the light emission operation. It is to be noted that like components are denoted by like numerals as of the display panel 1 according to the above-described first embodiment and will not be further described.

The display panel 2 includes a display drive section 60 and a display section 70, as with the display panel 1 (refer to FIG. 1) according to the above-described first embodiment. The display drive section 60 is configured to drive the display section 70. The display section 70 includes a plurality of pixels Q arranged in a matrix form. As with the pixels P according to the first embodiment, the pixels Q are arranged in a matrix of M pixels wide (horizontal) by N pixels high (vertical), and N number of pixels Q (Q(0) to Q(N−1)) arranged side by side along the vertical direction are connected in a daisy chain fashion with respect to the data signals PS and PD and the clock signal CK. In the display panel 2, as will be described below, the pixels Q are controlled with use of two kinds of pixel packets PCT11 and PCT12.

Figure 10A:
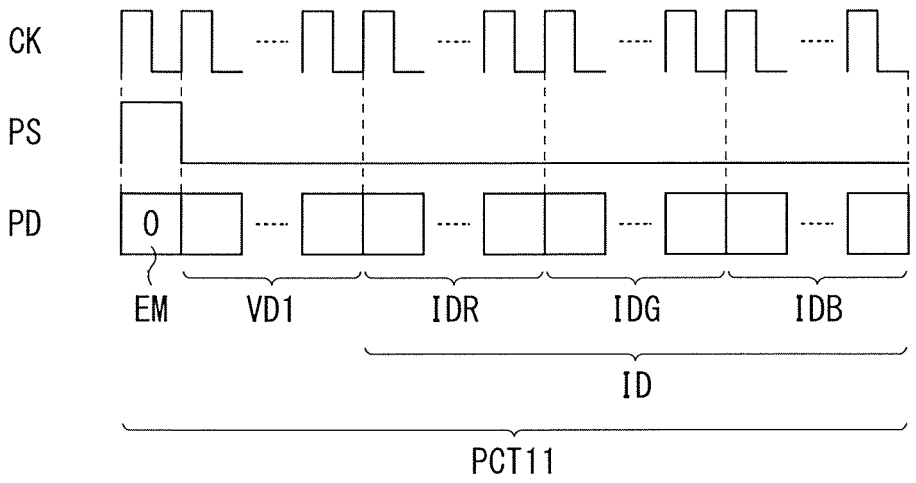
FIG. 10A is an explanatory diagram illustrating a configuration example of a pixel packet according to a second embodiment.
Figure 10B:
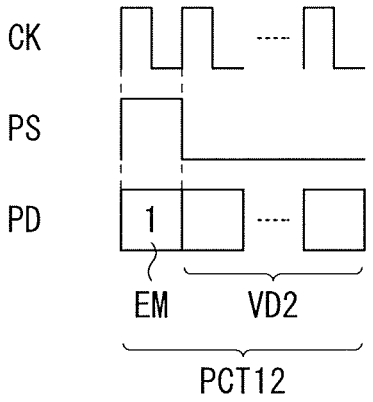
FIG. 10B is an explanatory diagram illustrating a configuration example of a pixel packet according to the second embodiment.

FIG. 10A illustrates a configuration example of the pixel packet PCT11, and FIG. 10B illustrates a configuration example of the pixel packet PCT12.

The pixel packet PCT11 is used in the operation of reading the luminance data ID, and as illustrated in FIG. 10A, the pixel packet PCT11 includes the flag EM with a value of "0", the variable data VD1, and the luminance data ID. In other words, the pixel packet PCT11 is the same as the pixel packet PCT1 in which the flag EM is "0" according to the above-described first embodiment. Therefore, in the operation of reading the luminance data ID, the display panel 2 is configured to operate in a similar manner.

The pixel packet PCT12 is used in the light emission operation, and as illustrated in FIG. 10B, the pixel packet PCT12 includes the flag EM with a value of "1", and variable data VD2. The variable data VD2 is data for determining whether or not each pixel Q is to perform the light emission operation, and indicates a value of 0 to a predetermined number L both inclusive. More specifically, each pixel Q decrements the value of the variable data VD2, and in a case where the variable data VD2 is "0", the pixel Q performs the light emission operation, based on the luminance data ID that has been already read. In this example, the flag EM and the variable data VD2 are arranged in this order in the pixel packet PCT12.

As illustrated in FIGS. 10A, and 10B, the data signal PS is a signal that is turned to "1" when the data signal PD indicates the flag EM, and is turned to "0" in other cases. In other words, the data signal PS is a signal that is turned to "1" only at the start of each of the pixel packets PCT11 and PCT12.

By this configuration, in a case where the flag EM is "0", each pixel Q determines that the pixel packet PCT11 is supplied, and performs an operation similar to the operation of reading the luminance data ID in the display panel 1 according to the above-described first embodiment.

Moreover, in a case where the flag EM is "1", each pixel Q determines that the pixel packet PCT12 is supplied, and reads the variable data VD2 in the pixel packet PCT12. Then, in a case where the value of the variable data VD2 is not "0", each pixel Q decrements the value of the variable data VD2, and in a case where the value of the variable data VD2 is "0", each pixel Q emits light with light emission luminance according to the luminance data ID that has been already read.

As illustrated in FIG. 3, each pixel Q includes a control section 71. The control section 71 is a state machine configured to set a state of the pixel Q, based on the input data signals PS and PD, and the input clock signal CK and generate the signals LD, PLT, and CKEN, and a control signal for the drive section 50.

The pixel Q corresponds to a specific example of "unit pixel" in an embodiment of the present disclosure. The pixel packet PCT11 corresponds to a specific example of "first pixel packet" in an embodiment of the present disclosure. The pixel packet PCT12 corresponds to a specific example "second pixel packet" in an embodiment of the present disclosure. The variable data VD2 corresponds to a specific example of "second variable data" in an embodiment of the present disclosure.

Figure 11:
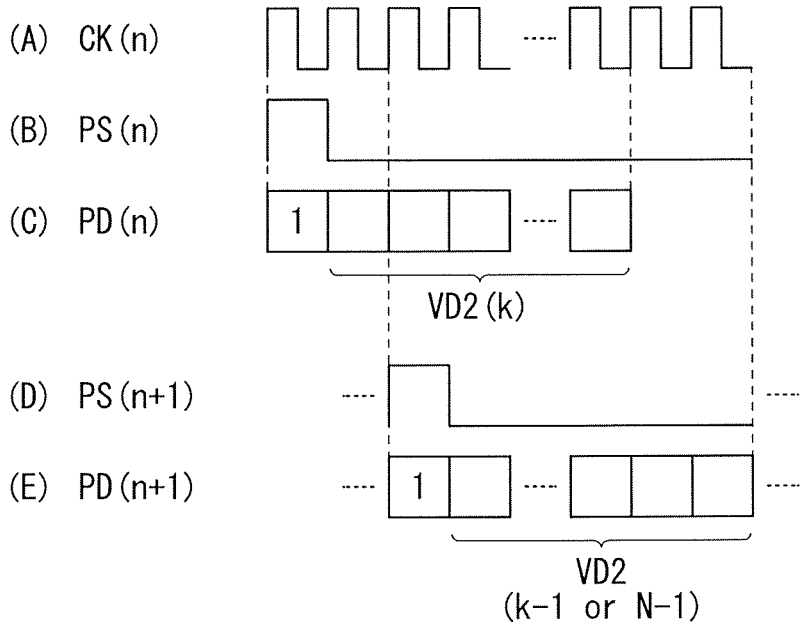
FIG. 11 is an explanatory diagram illustrating an operation example of a pixel according to the second embodiment.

FIG. 11 illustrates a light emission operation in an nth pixel Q(n) in a case where the pixel packet PCT12 is supplied, and parts (A) to (C) in FIG. 11 indicate a clock signal CK(n) and data signals PS(n) and PD(n) input to the pixel Q(n), respectively, and parts (D) and (E) indicate data signals PS(n+1) and PD(n+1) output from the pixel Q(n), respectively.

A pixel Q(n−1) previous to the pixel Q(n) supplies, to the pixel Q(n), the data signal PD(n) configured of the flag EM indicating "1" and the variable data VD2 indicating a value "k" together with the data signal PS(n) and the clock signal CK(n) (refer to the parts (A) to (C) in FIG. 11).

The control section 71 of the pixel Q(n) acquires, as the flag EM, the data signal PD(n) when the data signal PS(n) is turned to "1". In this example, since the flag EM is "1", the control section 71 determines that the pixel packet PCT12 is supplied, and acquires the value "k" of the variable data VD2 from the data signal PD(n). Then, the control section 71 supplies the signals LD and PLT to the selector section 43, and the selector section 43 changes the value "k" of the variable data VD2 in the data signal PDA (refer to FIG. 3) into a decremented value "k−1" to generate the data signal PDB. At this time, in a case where the value "k" of the variable data VD2 is "0", as a result of decrementing the value "k", the value "k" is changed into the predetermined value L by wrap processing.

In a case where the value "k" of the variable data VD2 is not "0", the control section 71 does not supply a control signal (a clock signal for counter) to the counter 55 of the drive section 50. In other words, the control section 71 does not allow the light-emitting devices 48R, 48G, and 48B to emit light.

On the other hand, in a case where the value "k" of the variable data VD2 is "0", the control section 71 supplies the control signal (the clock signal for counter) to the counter 55 of the drive section 50, and the counter 55 generates pulse signals with pulse widths according to the luminance data IDR, IDG, and IDB. Then, the light-emitting devices 48R, 48G, and 48B emit light with light emission luminance according to these pulse widths.

Then, the pixel Q(n) delays the data signals PS(n) and PD(n) without change by two clocks to output the delayed data signals PS(n) and PD(n) as data signals PS(n+1) and PD(n+1), respectively (refer to the parts (D) and (E) in FIG. 11).

Next, as a more specific example, the light emission operation in a case where four pixels Q(0) to Q(3) are connected in a daisy chain fashion will be described below. In this example, description will be given in a case where the predetermined number L is 1 (L=1).

FIGS. 12A to 12E illustrate light emission operations in the pixels Q(0) to Q(3). Two frames of the data signal PD (the pixel packet PCT12) in an upper portion of each of these diagrams illustrate the flag EM and the variable data VD2 in this order from the left.

Figure 12A:
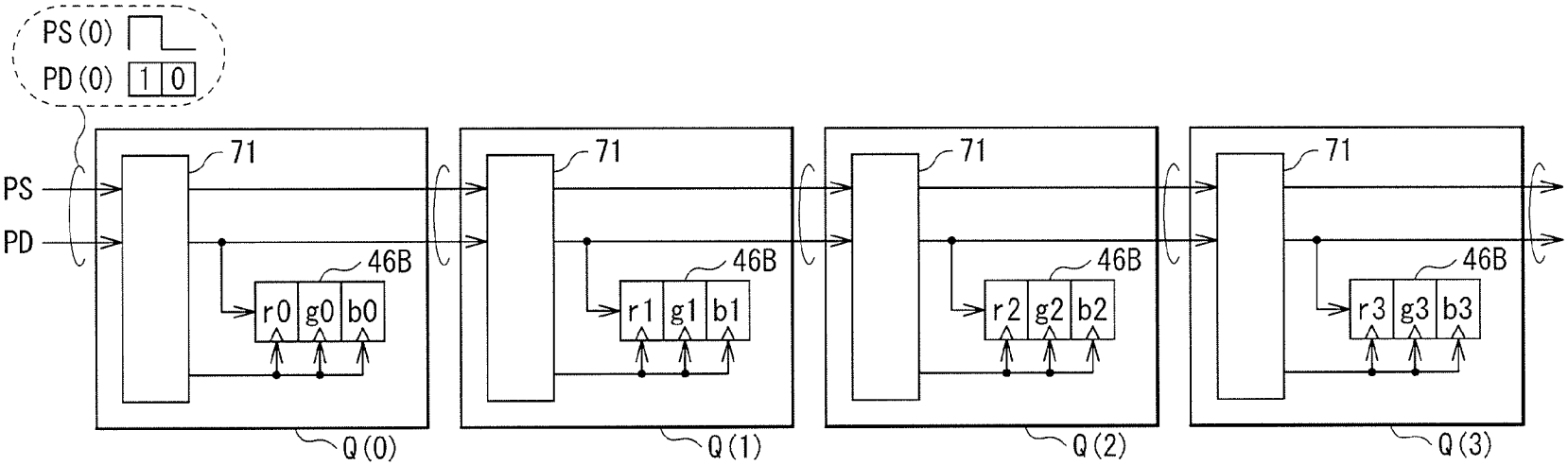
FIG. 12A is an explanatory diagram illustrating an operation example of a display panel according to the second embodiment.

The display drive section 60 generates the data signal PD(0) (the pixel packet PCT12) configured of the flag EM indicating "1" and the variable data VD2 indicating "0", and supplies, to the pixel Q(0) in a first stage, the data signal PD(0) together with the data signal PS(0) and the clock signal CK(0) (refer to FIG. 12A).

Figure 12B:
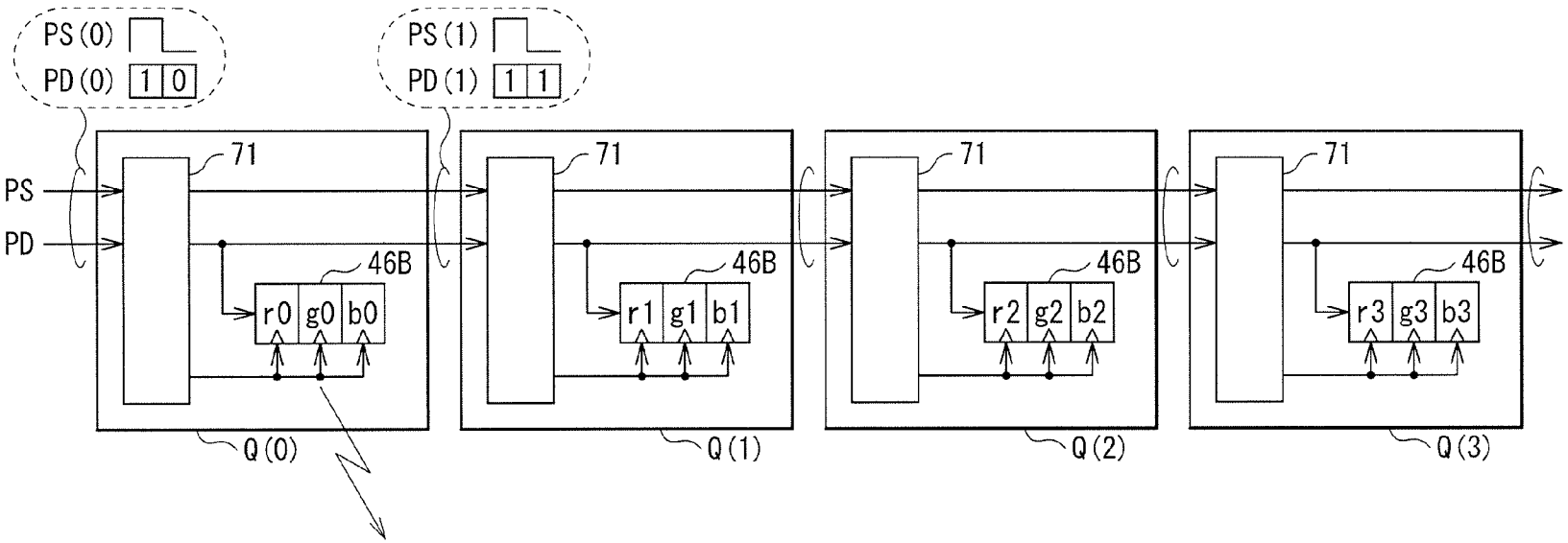
FIG. 12B is an explanatory diagram illustrating the operation example of the display panel according to the second embodiment.
Figure 12C:
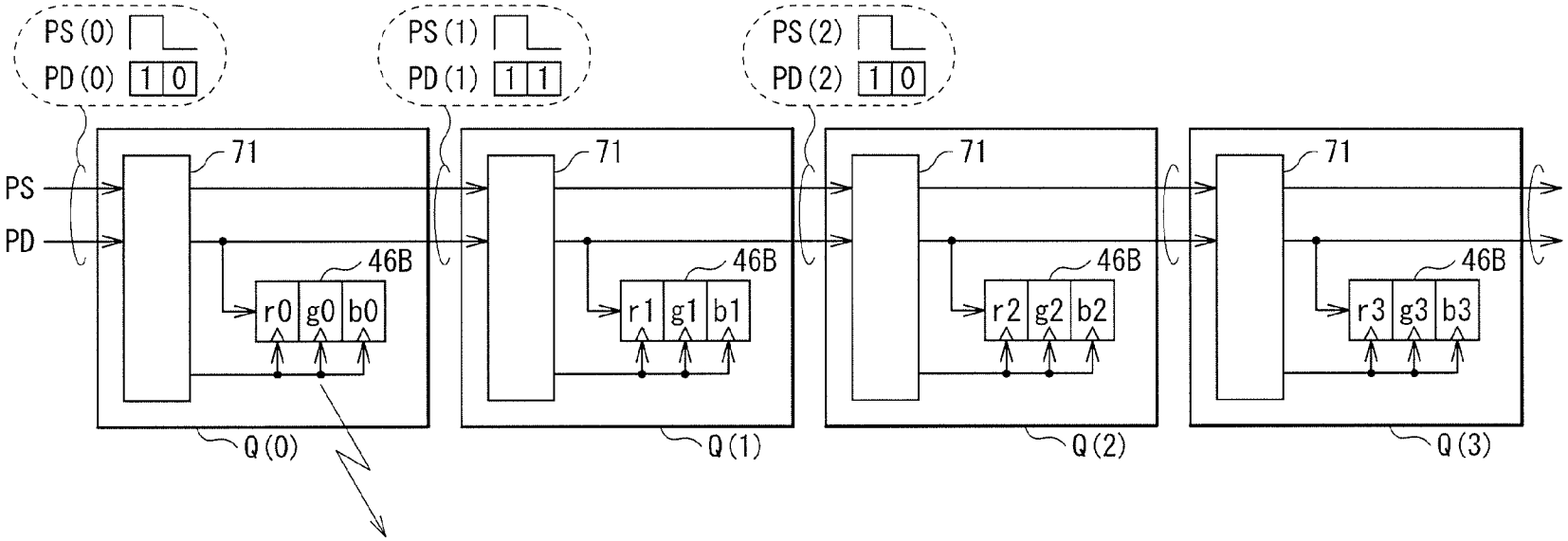
FIG. 12C is an explanatory diagram illustrating the operation example of the display panel according to the second embodiment.

Since the value of the variable data VD2 included in the data signal PD(0) is "0", the pixel Q(0) changes the value of the variable data VD2 into "1" (the predetermined value L), and emits light with luminance according to the luminance data IDR, IDG, and IDB ("r0", "g0", and "b0") that have been already read (refer to FIG. 12B). Then, the pixel Q(0) outputs the data signal PD(1) in which the value of the variable data VD2 is "1" together with the data signal PS(1). The pixel Q(1) decrements the value "1" of the variable data VD2 included in the data signal PD(1) to generate the data signal PD(2) in which the value of the variable data VD2 is "0", and outputs the data signal PD(2) together with the data signal PS(2) (refer to FIG. 12C).

Figure 12D:
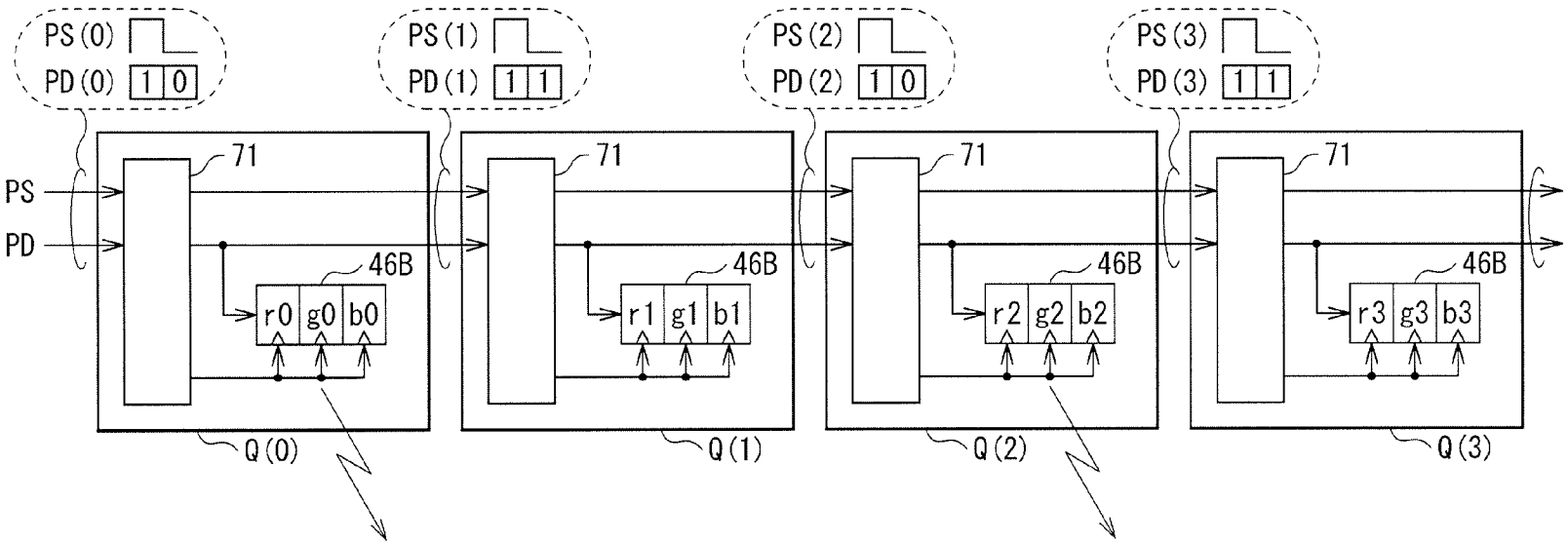
FIG. 12D is an explanatory diagram illustrating the operation example of the display panel according to the second embodiment.
Figure 12E:
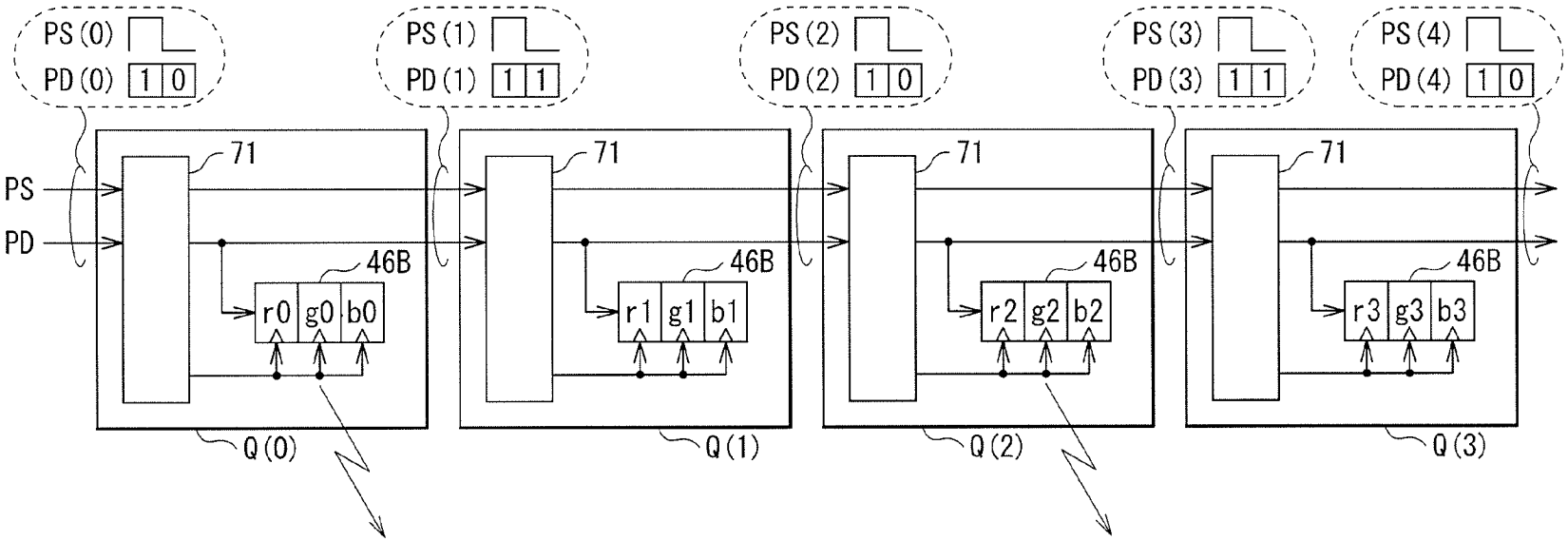
FIG. 12E is an explanatory diagram illustrating the operation example of the display panel according to the second embodiment.

Since the value of the variable data VD2 included in the data signal PD(2) is "0", the pixel Q(2) changes the value of the variable data VD2 into "1" (the predetermined value L), and emits light with luminance according to the luminance data IDR, IDG, and IDB ("r2", "g2", and "b2") that have been already read (refer to FIG. 12D). Then, the pixel Q(2) outputs the data signal PD(3) in which the value of the variable data VD2 is "1" together with the data signal PS(3). The pixel Q(3) decrements the value "1" of the variable data VD2 included in the data signal PD(3) to generate the data signal PD(4) in which the value of the variable data VD2 is "0", and outputs the data signal PD(4) together with the data signal PS(4) (refer to FIG. 12E).

Therefore, in the display panel 2, even-numberth pixels Q (Q(0) and Q(2)) emit light, based on the luminance data IDR, IDG, and IDB that have been already read. In other words, in this example, the display drive section 60 generates the data signal PD(0) that includes the variable data VD2 indicating "0"; therefore, the even-numberth pixels Q (Q(0) and Q(2)) performs the light emission operation.

FIGS. 13A to 13E illustrate another example of the light emission operation in the pixels Q(0) to Q(3). In this example, the display drive section 60 generates the data signal PD(0) (the pixel packet PCT12) that includes the variable data VD2 indicating "1", and supplies, to the pixel Q(0) in the first stage, the data signal PD(0) together with the data signal PS(0) and the clock signal CK(0) (refer to FIG. 13A).

Figure 13A:
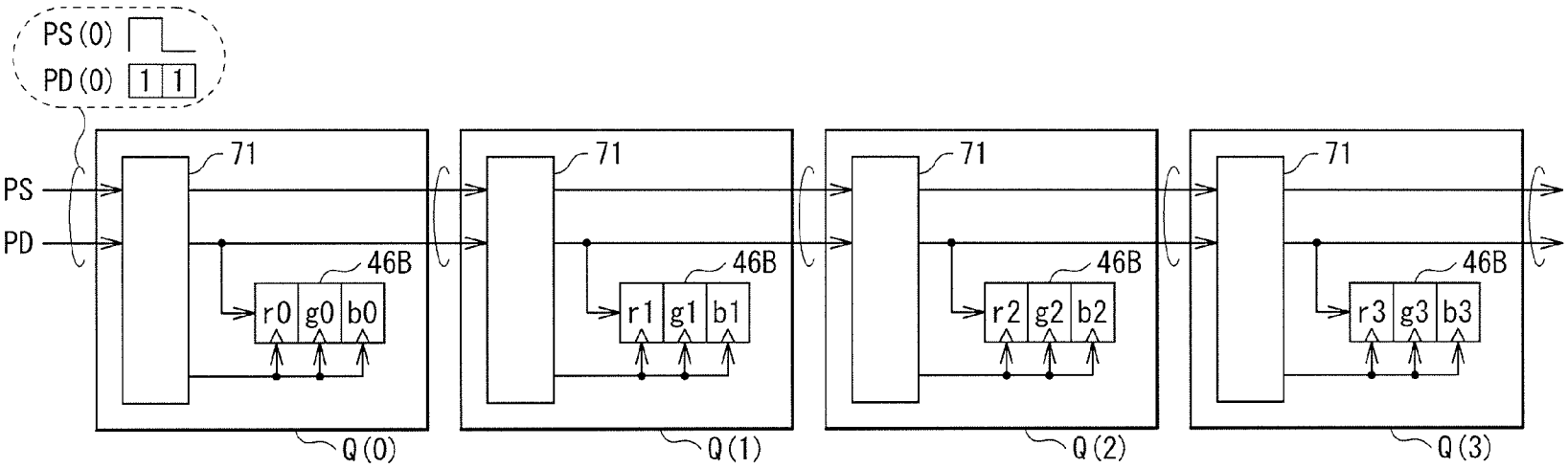
FIG. 13A is an explanatory diagram illustrating an operation example of the display panel according to the second embodiment.
Figure 13B:
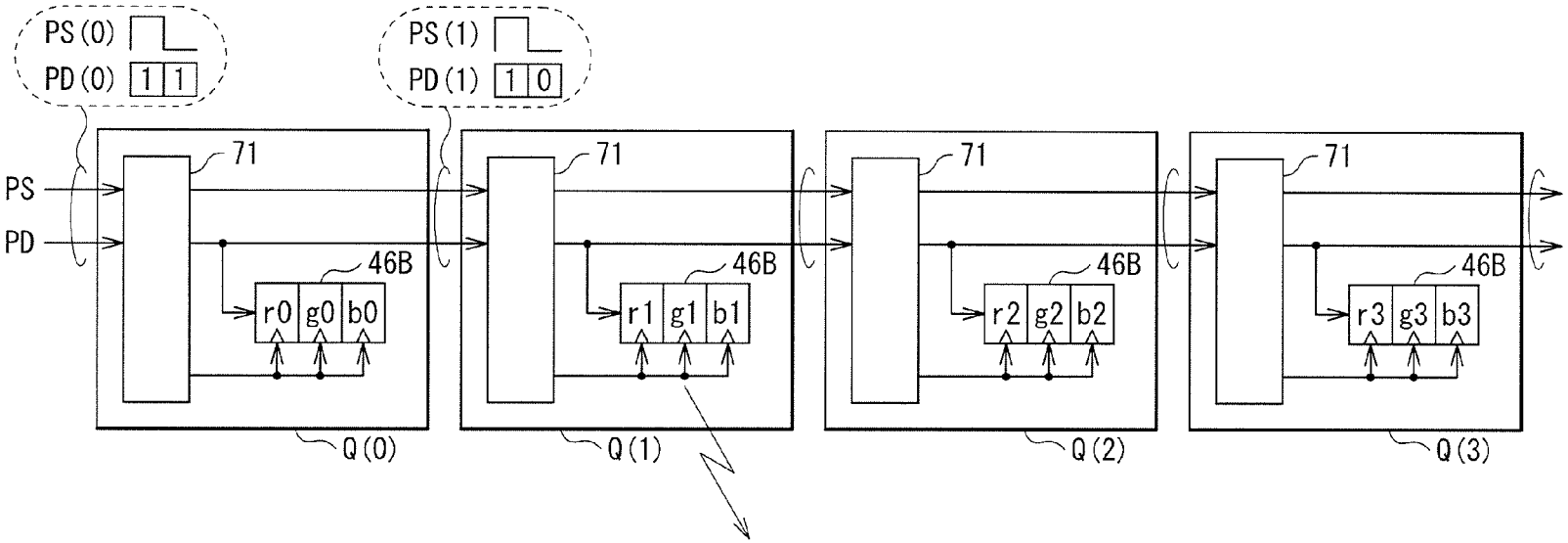
FIG. 13B is an explanatory diagram illustrating the operation example of the display panel according to the second embodiment.
Figure 13C:
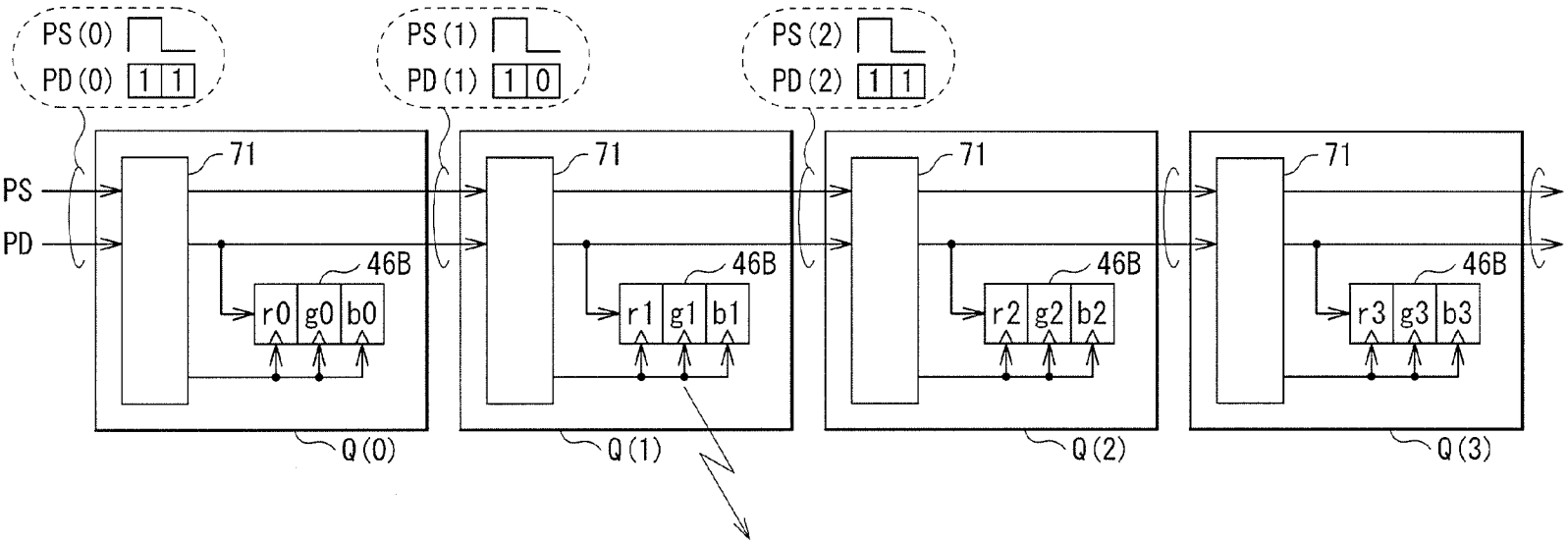
FIG. 13C is an explanatory diagram illustrating the operation example of the display panel according to the second embodiment.

The pixel Q(0) decrements the value "1" of the variable data VD2 included in the data signal PD(0) to generate the data signal PD(1) in which the value of the variable data VD2 is "0", and outputs the data signal PD(1) together with the data signal PS(1) (refer to FIG. 13B). Since the value of the variable data VD2 included in the data signal PD(1) is "0", the pixel Q(1) changes the value of the variable data VD2 into "1" (the predetermined value L), and emits light with luminance according to the luminance data IDR, IDG, and IDB ("r1", "g1", and "b1") that have been already read (refer to FIG. 13C). Then, the pixel Q(1) outputs the data signal PD(2) in which the value of the variable data VD2 is "1" together with the data signal PS(2).

Figure 13D:
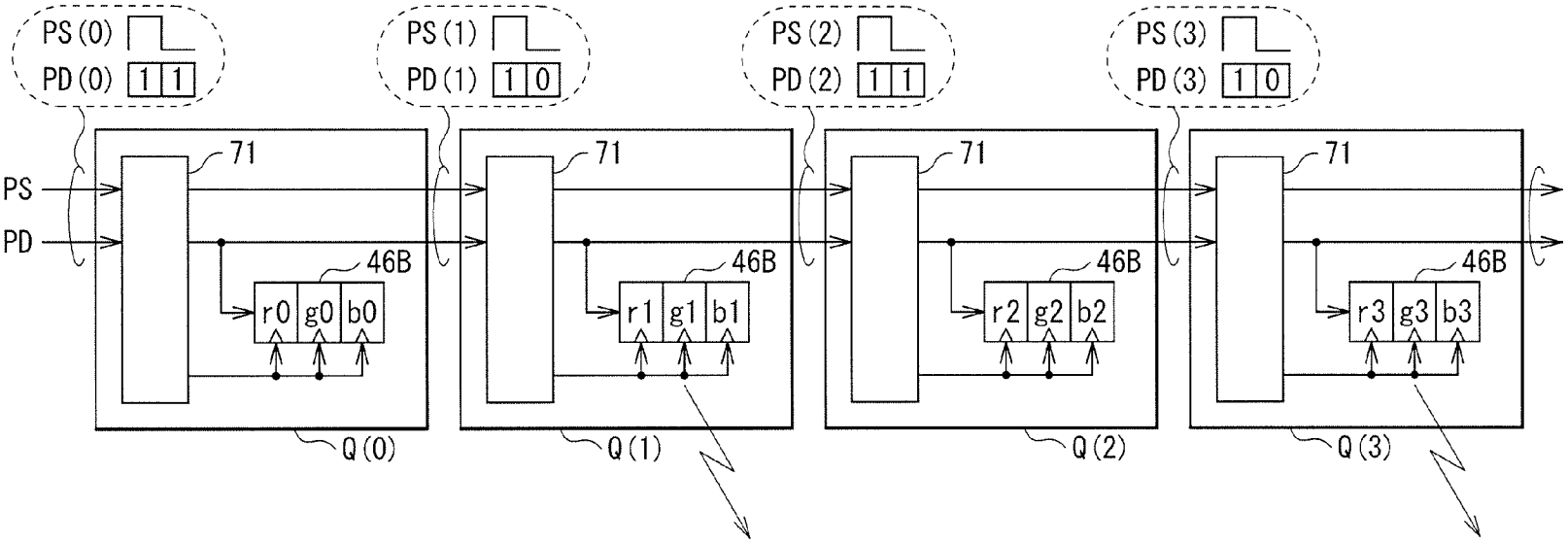
FIG. 13D is an explanatory diagram illustrating the operation example of the display panel according to the second embodiment.
Figure 13E:
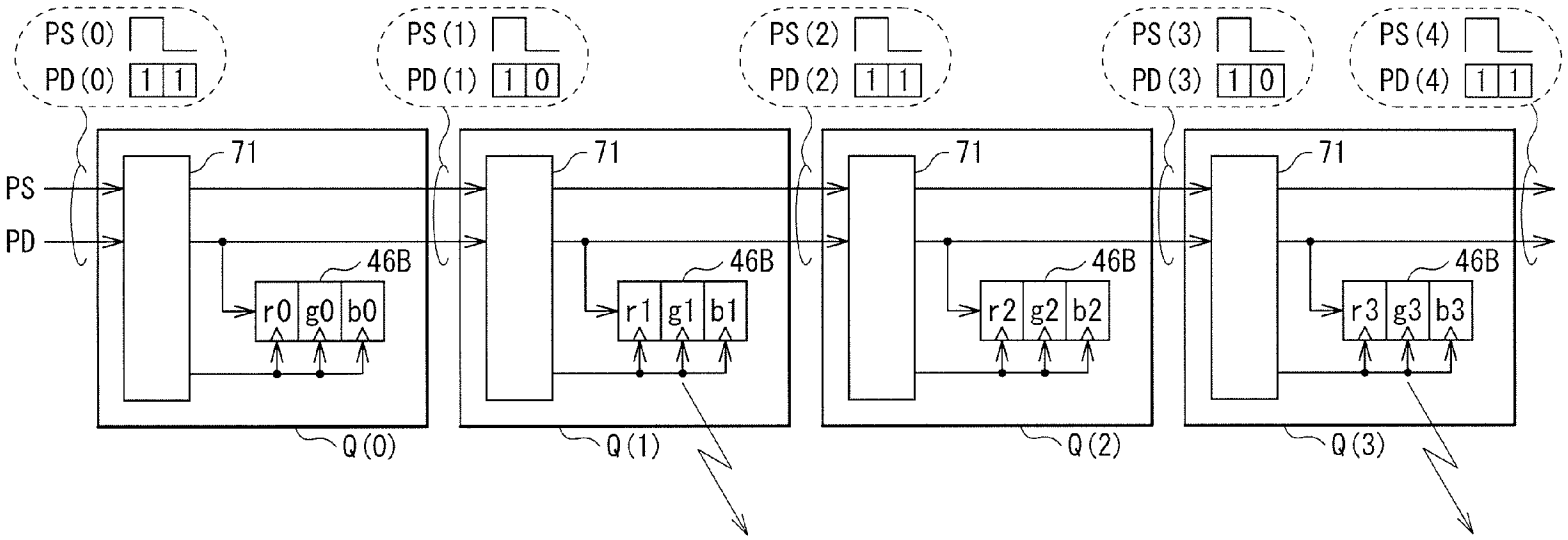
FIG. 13E is an explanatory diagram illustrating the operation example of the display panel according to the second embodiment.

The pixel Q(2) decrements the value "1" of the variable data VD2 included in the data signal PD(2) to generate the data signal PD(3) in which the value of the variable data VD2 is "0", and outputs the data signal PD(3) together with the data signal PS(3) (refer to FIG. 13D). Since the value of the variable data VD2 included in the data signal PD(3) is "0", the pixel Q(3) changes the value of the variable data VD2 into "1" (the predetermined value L), and emits light with luminance according to the luminance data IDR, IDG, and IDB ("r3", "g3", and "b3") (refer to FIG. 13E). Then, the pixel Q(3) outputs the data signal PD(4) in which the value of the variable data VD2 is "1" together with the data signal PS(4).

Thus, in the display panel 2, odd-numberth pixels Q (Q(1) and Q(3)) emit light, based on the luminance data IDR, IDG, and IDB that have been already read. In other words, in this example, the display drive section 60 generates the data signal PD(0) that includes the variable data VD2 indicating "1"; therefore, the odd-numberth pixels Q (Q(1) and Q(3)) perform the light emission operation.

As described above, in the display panel 2, the pixel Q that is to perform the light emission operation is allowed to be selected. Therefore, a display operation with higher flexibility is allowed to be performed. An example of a display operation in which the light emission operation illustrated in FIGS. 12A to 12E and the light emission operation illustrated in FIGS. 13A to 13E are combined will be described below.

Figure 14:
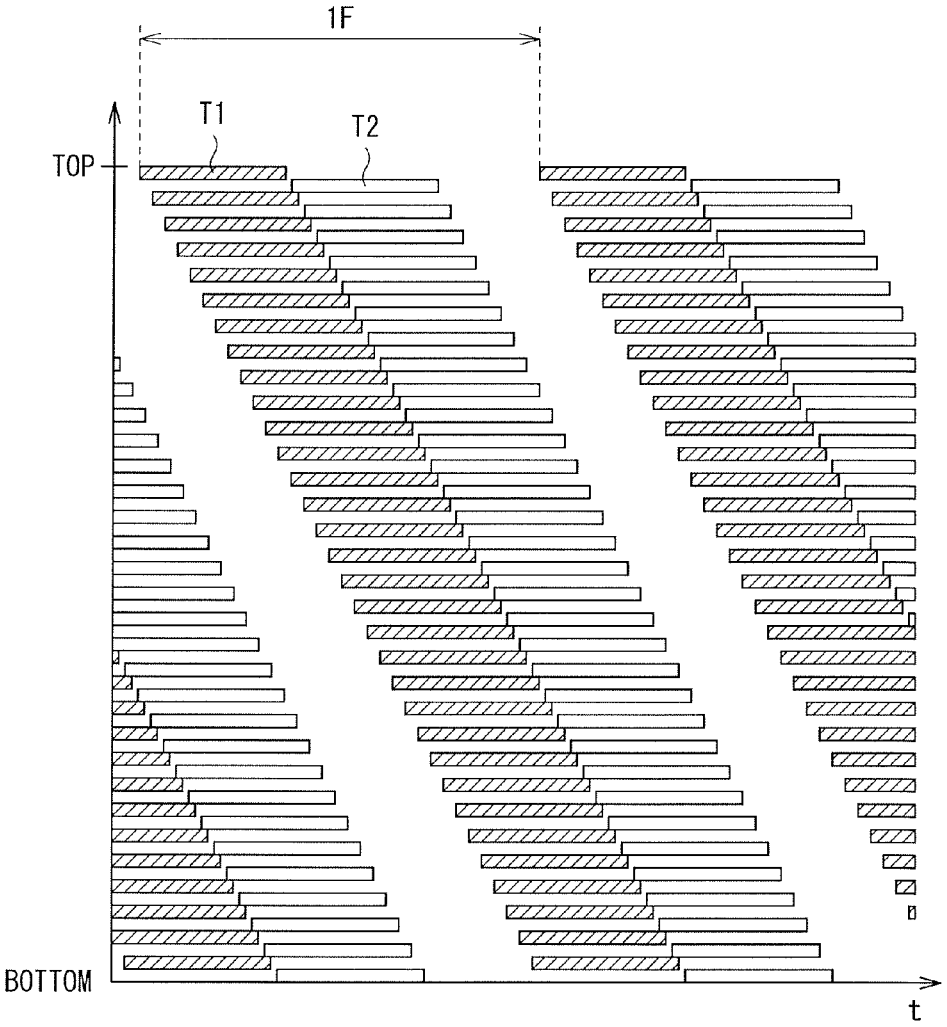
FIG. 14 is an explanatory diagram illustrating another operation example of the display panel according to the second embodiment.

FIG. 14 illustrates an example of the display operation in the display panel 2. In FIG.14, a vertical axis indicates a position in a vertical direction (a longitudinal direction) in a display screen of the display section 20, and a horizontal axis indicates time t. In this example, the display panel 2 sequentially performs light emission operations T1 of even-numberth pixels (Q(0), Q(2), . . . ) and light emission operations T2 of odd-numberth pixels Q (Q(1), Q(3), . . . ) from the top of the display screen. The light emission operation T1 corresponds to the light emission operation illustrated in FIGS. 12A to 12E. The light emission operation T2 corresponds to the light emission operation illustrated in FIGS. 13A to 13E. Lengths in a horizontal axis direction of the light emission operations T1 and T2 indicate light emission time of the pixel Q. It is to be noted that, in actuality, the lengths of the light emission operations T1 and T2 are changed depending on the luminance data IDR, IDG, and IDB; however, in FIG. 14, the light emission operations T1 and T2 are indicated by lengths corresponding to a longest light emission period (i.e., maximum light emission luminance). Thus, in the display panel 2, so-called interlaced display is allowed to be performed by a combination of the light emission operation T1 and the light emission operation T2.

Thus, in the display panel 2, the pixel packet PCT12 for the light emission operation is provided in addition to the pixel packet PCT11 for the operation of reading the luminance data ID, and the pixel packet PCT12 including the variable data VD2 is transmitted. Then, each pixel Q determines whether or not to perform the light emission operation, based on the variable data VD2. Therefore, in the display panel 2, since the pixel Q that is to perform the light emission operation is allowed to be selected, the display operation with higher flexibility is allowed to be performed.

As described above, in this embodiment, the pixel packet for light emission operation is provided; therefore, the display operation with higher flexibility is allowed to be performed. Other effects are similar to those in the above-described first embodiment.

MODIFICATION EXAMPLE 2-1

In the above-described embodiment, the predetermined number L is set to 1 (L=1), and one of every two pixels Q performs the light emission operation; however, the predetermined number L is not limited thereto, and may be arbitrarily set. For example, in a case where the predetermined number L is set to 2 (L=2), one of every three pixels Q may perform the light emission operation, and in a case where the predetermined number L is set to 3 (L=3), one of every four pixels Q may perform the light emission operation.

MODIFICATION EXAMPLE 2-2

Modification Examples 1-1 to 1-3 of the above-described first embodiment may be applied to the display panel 2 according to the above-described embodiment.

(3. Third Embodiment)

Next, a display panel 3 according to a third embodiment will be described below. In this embodiment, a pixel packet is configured without including variable data. It is to be noted that like components are denoted by like numerals as of the display panel 1 according to the above-described first embodiment and will not be further described.

The display panel 3 includes a display drive section 80 and a display section 90, as with the display panel 1 (refer to FIG. 1) according to the above-described first embodiment. The display drive section 80 is configured to drive the display section 90. The display section 90 includes a plurality of pixels R arranged in a matrix form. In this example, as with the pixel P according to the first embodiment, the pixels R are arranged in a matrix of M pixels wide (horizontal) by N pixels high (vertical), and N number of pixels R (R(0) to R(N−1)) arranged side by side along the vertical direction are connected in a daisy chain fashion with respect to the data signals PS and PD and the clock signal CK. As will be described later, the pixels R are configured to be allowed to hold light emission timing data ETD for determination of a light emission start timing in addition to the luminance data ID. In the display panel 3, the display drive section 80 is configured to supply a group of N number of pixel packets configured with use of three kinds of pixel packets PCT21, PCT22, and PCT23 to the N number of pixels R connected in a daisy chain fashion.

Figure 15A:
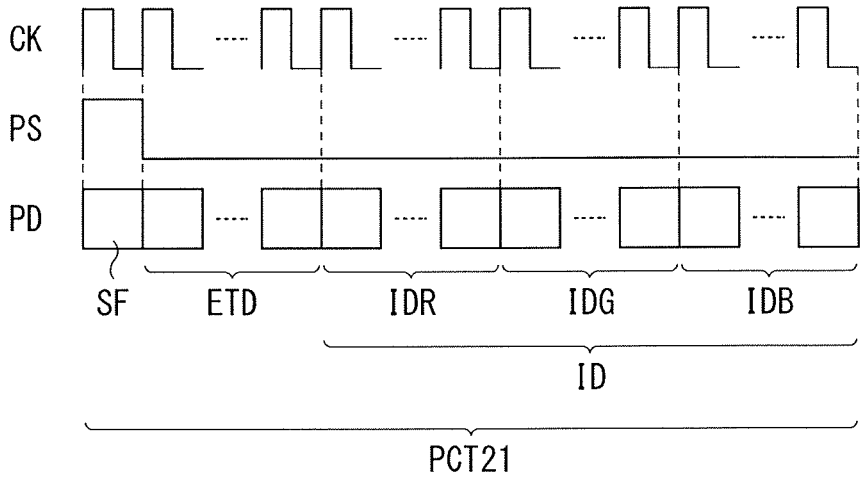
FIG. 15A is an explanatory diagram illustrating a configuration example of a pixel packet according to a third embodiment.
Figure 15B:
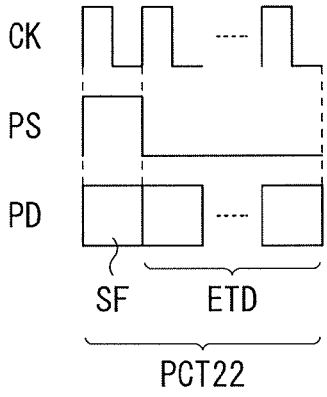
FIG. 15B is an explanatory diagram illustrating a configuration example of a pixel packet according to the third embodiment.
Figure 15C:
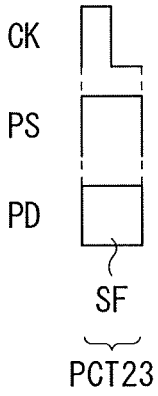
FIG. 15C is an explanatory diagram illustrating a configuration example of a pixel packet according to the third embodiment.

FIGS. 15A, 15B, and 15C illustrate a configuration example of the pixel packet PCT21, a configuration example of the pixel packet PCT22, and a configuration example of the pixel packet PCT23, respectively.

The pixel packet PCT21 is used in an operation of reading the luminance data ID and the light emission timing data ETD, and as illustrated in FIG. 15A, the pixel packet PCT21 includes the luminance data ID, light emission timing data ETD, and a start flag SF. The light emission timing data ETD is configured to determine a light emission start timing in each pixel R, and is a code of a plurality of bits. The start flag SF indicates the start of the pixel packet PCT21. The start flag SF is turned to "1" only in a first pixel packet of the pixel packets PCT21 to PCT23 that have not yet been read by any of the pixels R in the pixel packet group supplied to the N number of pixels R connected in a daisy chain fashion. In this example, the start flag SF, the light emission timing data ETD, and the luminance data ID are arranged in this order in the pixel packet PCT21.

The pixel packet PCT22 is used in an operation of reading the light emission timing data ETD. In other words, the pixel packet PCT22 is used in a case where only rewriting of the light emission timing data ETD is performed without performing rewriting of the luminance data ID. As illustrated in FIG. 15B, the pixel packet PCT22 includes the start flag SF and the light emission timing data ETD. The start flag SF is similar to that in the pixel packet PCT21. In this example, the start flag SF and the light emission timing data ETD are arranged in this order in the pixel packet PCT22.

The pixel packet PCT23 is used in a case where rewriting of both the luminance data ID and the light emission timing data ETD is not performed. As illustrated in FIG. 15C, the pixel packet PCT23 includes the start flag SF. The start flag SF is similar to that in the pixel packet PCT21.

As illustrated in FIGS. 15A to 15C, the data signal PS is a signal that is turned to "1" when the data signal PD indicates the start flag SF, and is turned to "0" in other cases. In other words, the data signal PS is a signal that is turned to "1" at the start of each of the pixel packets PCT21 to PCT23.

Figure 16:
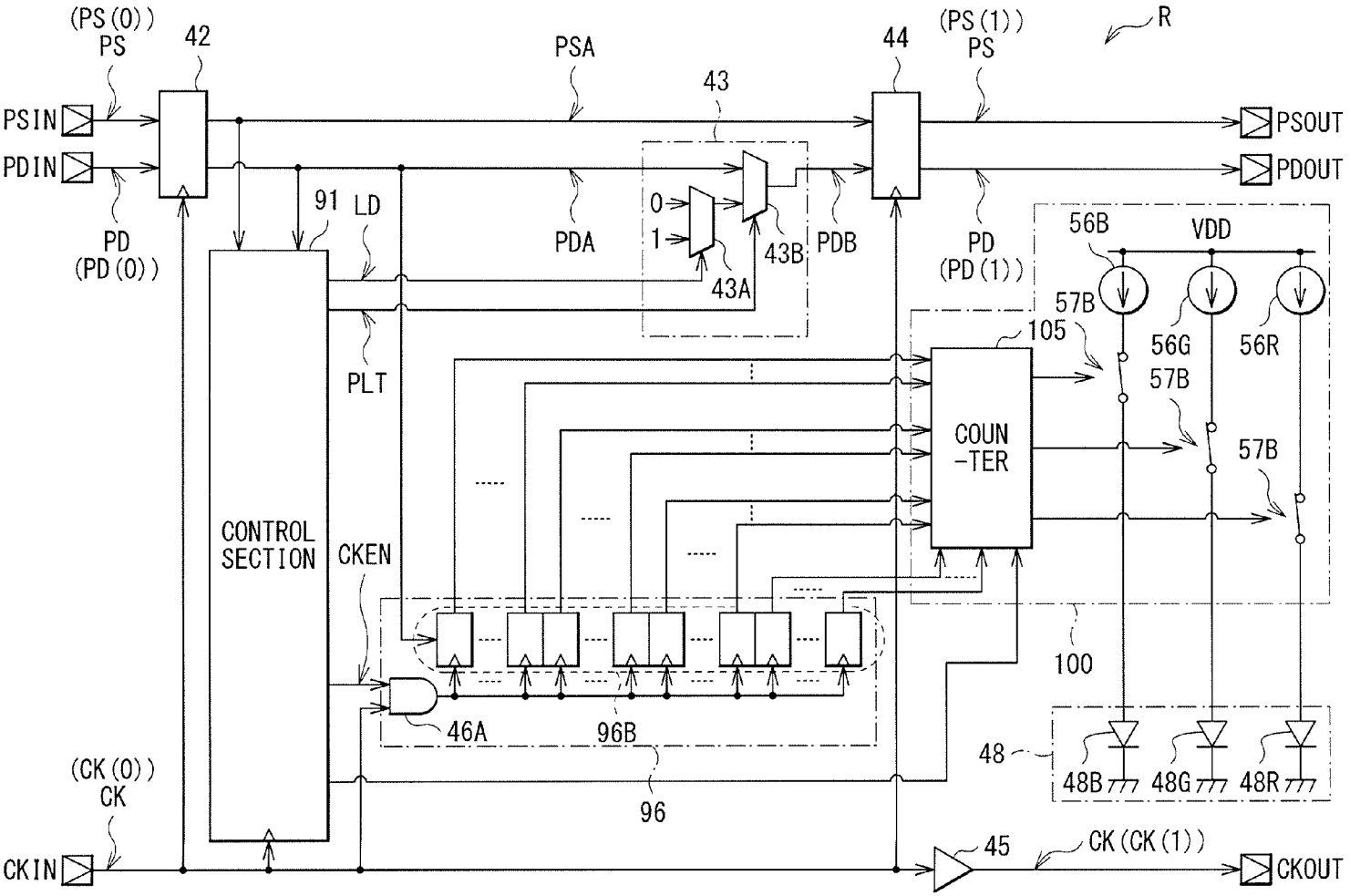
FIG. 16 is a block diagram illustrating a configuration example of a pixel according to the third embodiment.

FIG. 16 illustrates a configuration example of the pixel R. The pixel R includes a control section 91, a memory section 96, and a drive section 100.

The control section 91 is a state machine configured to set a state of the pixel R, based on the input data signals PS and PD, and the input clock signal CK and generate the signals LD, PLT, and CKEN, and a control signal for the drive section 100.

The memory section 96 includes a shift register 96B. The shift register 96B is configured to hold the luminance data ID and the light emission timing data ETD. More specifically, in this example, the shift register 96B holds the light emission timing data ETD configured of a plurality of bits, 12-bit luminance data IDR, 12-bit luminance data IDG, and 12-bit luminance data IDB from a last portion thereof.

The drive section 100 includes a counter 105. The counter 105 is configured to generate pulse signals with pulse widths according to the luminance data IDR, IDG, and IDB by counting clock pulses of a control signal (a clock signal for counter) supplied from the control section 91 with use of the control signal as a reference. At this time, the counter 105 is configured to perform control, based on the light emission timing data ETD supplied from the memory section 96 so as to allow these pulse signals to start at a timing according to the light emission timing data ETD.

The pixel R corresponds to a specific example of "unit pixel" in an embodiment of the present disclosure. The pixel packet PCT21 corresponds to a specific example of "first pixel packet" in an embodiment of the present disclosure. The pixel packets PCT22 and PCT23 correspond to specific examples of "second pixel packet" in an embodiment of the present disclosure. The start flag SF corresponds to a specific example of "flag data" in an embodiment of the present disclosure. The light emission timing data ETD corresponds to a specific example of "timing data" in an embodiment of the present disclosure.

Figure 17:
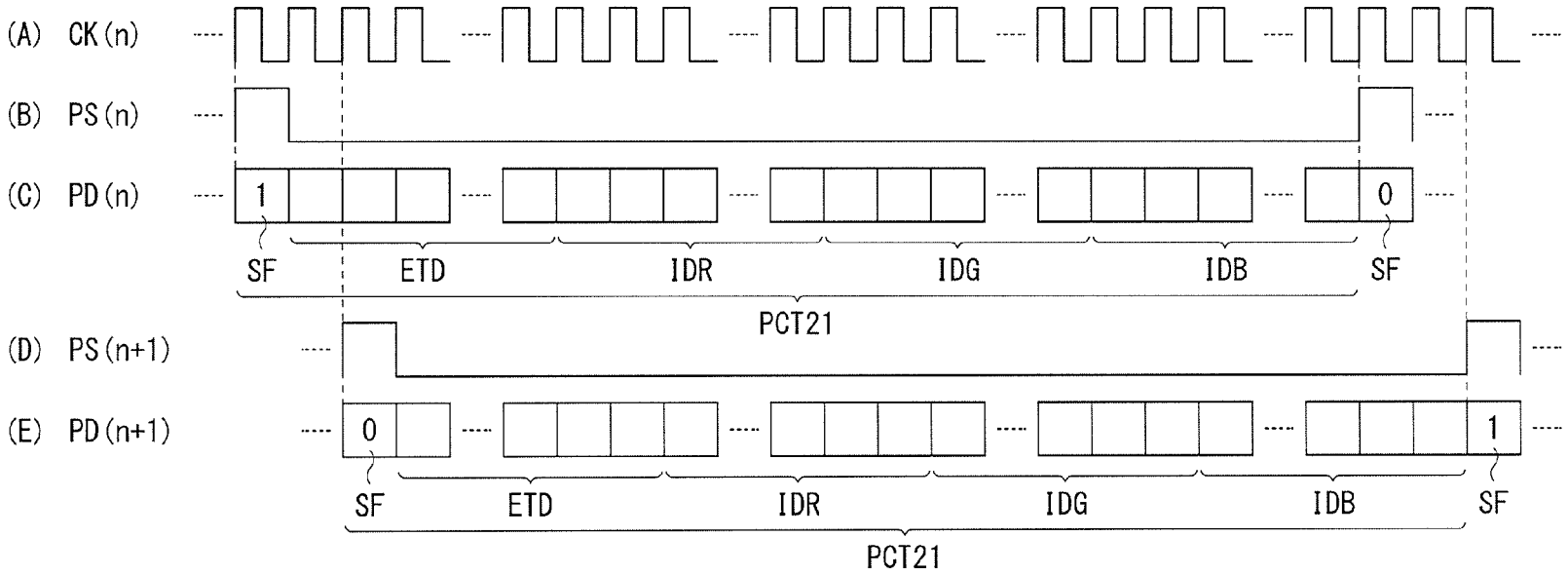
FIG. 17 is an explanatory diagram illustrating an operation example of the pixel according to the third embodiment.

FIG. 17 illustrates an operation in an nth pixel R(n) in a case where the pixel packet PCT21 in which a value of the start flag SF is "1" is supplied. Parts (A) to (C) in FIG. 17 indicate the clock signal CK(n) and the data signal PS(n) and PD(n) that are input to the pixel R(n), respectively, and parts (D) and (E) in FIG. 17 indicate data signals PS(n+1) and PD(n+1) that are output from the pixel R(n), respectively.

A pixel R(n−1) previous to the pixel R(n) supplies, to the pixel R(n), the data signal PD(n) (the pixel packet PCT21) configured of the start flag SF indicating "1", the light emission timing data ETD, and the luminance data IDR, IDG, and IDB together with the data signal PS(n) and the clock signal CK(n) (refer to the parts (A) to (C) in FIG. 17).

The control section 91 of the pixel R(n) acquires, as the start flag SF, the data signal PD(n) when the data signal PS(n) is turned to "1". In this example, since the start flag SF is "1", the control section 91 supplies the signals LD and PLT to the selector section 43, and the selector section 43 changes the start flag SF in the data signal PDA (refer to FIG. 3) into "0". Next, the control section 91 supplies the signal CKEN to the memory section 96, and the memory section 96 holds data (the light emission timing data ETD and the luminance data ID) sandwiched between that start flag SF and the start flag SF in a subsequent pixel packet (any one of the pixel packet PCT21 to PCT23). Then, the control section 91 supplies the signals LD and PLT to the selector section 43, and the selector 43 changes all of the data sandwiched between the start flag SF in the data signal PDA and the subsequent start flag SF into "0", and then changes the start flag SF into "1" to generate the data signal PDB. Then, the pixel R(n) emits light with durations corresponding to the luminance data IDR, IDG, and IDB read from the pixel packet PCT21 from a timing according to the light emission timing data ETD read from the pixel packet PCT21.

Then, the pixel R(n) generates the data signal PD(n+1) in such a manner, and outputs the data signal PD(n+1) together with the data signal PS(n+1) (refer to the parts (D) and (E) in FIG. 17). At this time, as illustrated in FIG. 16, the pixel R(n) includes two flip-flops 42 and 44; therefore, the data signals PS(n+1) and PD(n+1) are signals delayed from the data signals PS(n) and PD(n) by two clocks.

In FIG. 17, a case where the pixel packet PCT21 in which the value of the start flag SF is "1" is supplied is illustrated; however, in a case where the pixel packet PCT21 in which the value of the start flag SF is "0" is supplied, the control section 91 does not generate the signals LD, PLT, and CKEN. Therefore, the pixel R(n) does not perform rewriting of the start flag SF and an end flag EF and reading of the light emission timing data ETD and the luminance data ID, and delays the input data signals PS(n) and PD(n) without change by two clocks, and outputs the delayed data signals PS(n) and PD(n) as the data signal PS(n+1) and PD(n+1).

Figure 18:
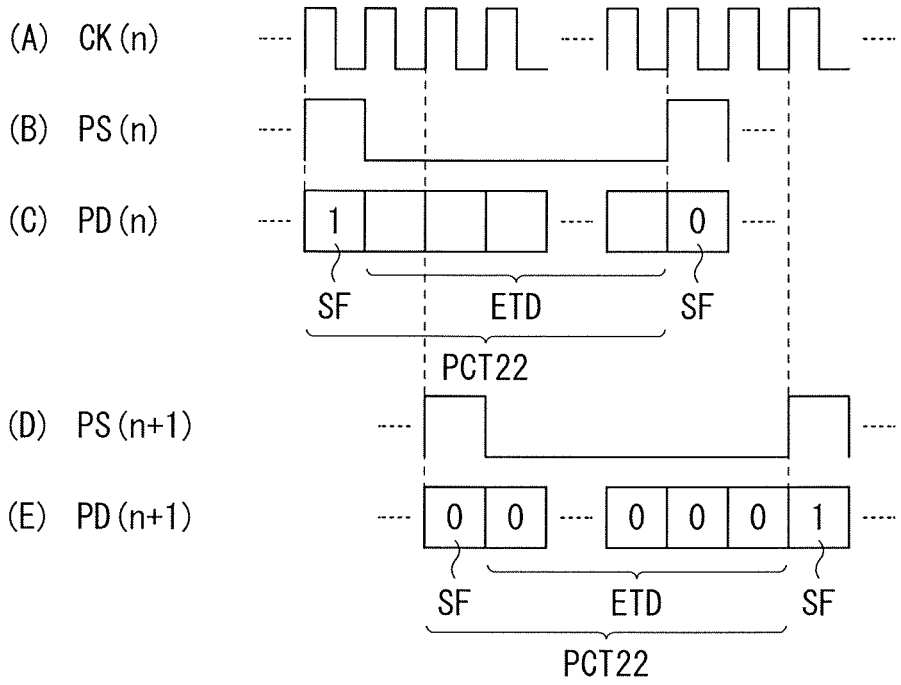
FIG. 18 is an explanatory diagram illustrating another operation example of the pixel according to the third embodiment.

FIG. 18 illustrates an operation in the nth pixel R(n) in a case where the pixel packet PCT22 in which the value of the start flag SF is "1" is supplied. Parts (A) to (C) in FIG. 18 indicate the clock signal CK(n) and the data signals PS(n) and PD(n) that are input to the pixel R(n), respectively, and parts (D) and (E) in FIG. 18 indicate the data signal PS(n+1) and PD(n+1) that are output from the pixel R(n), respectively.

The pixel R(n−1) previous to the pixel R(n) supplies, to the pixel R(n), the data signal PD(n) (the pixel packet PCT22) configured of the start flag SF indicating "1" and the light emission timing data ETD together with the data signal PS(n) and the clock signal CK(n) (refer to the parts (A) to (C) in FIG. 18).

The control section 91 of the pixel R(n) acquires, as the start flag SF, the data signal PD(n) when the data signal PS(n) is turned to "1". In this example, since the start flag SF is "1", the control section 91 supplies the signals LD and PLT to the selector section 43, and the selector section 43 changes the start flag SF in the data signal PDA (refer to FIG. 16) into "0". Next, the control section 91 supplies the signal CKEN to the memory section 96, and the memory section 96 holds data (the light emission timing data ETD) sandwiched between that start flag SF and the start flag SF in a subsequent pixel packet (any one of the pixel packets PCT21 to PCT23). Then, the control section 91 supplies the signals LD and PLT to the selector section 43, and the selector 43 changes all of the data sandwiched between the start flag SF in the data signal PDA and the subsequent start flag SF into "0", and changes the subsequent start flag SF into "1" to generate the data signal PDB. Then, the pixel R(n) emits light with durations corresponding to the luminance data IDR, IDG, and IDB that have been already read from a timing corresponding to the light emission timing data ETD read from the pixel packet PCT22.

Then, the pixel R(n) generates the data signal PD(n+1) in such a manner, and outputs the data signal PD(n+1) together with the data signal PS(n+1) (refer to the parts (D) and (E) in FIG. 18).

In FIG. 18, a case where the pixel packet PCT22 in which the value of the start flag SF is "1" is supplied is illustrated; however, in a case where the pixel packet PCT22 in which the value of the start flag SF is "0" is supplied, the control section 91 does not generate the signals LD, PLT, and CKEN. Therefore, the pixel R(n) does not perform rewriting of the start flag SF and the end flag EF and reading of the light emission timing data ETD, and outputs the input data signals PS(n) and PD(n) without change as the data signals PS(n+1) and PD(n+1).

Figure 19:
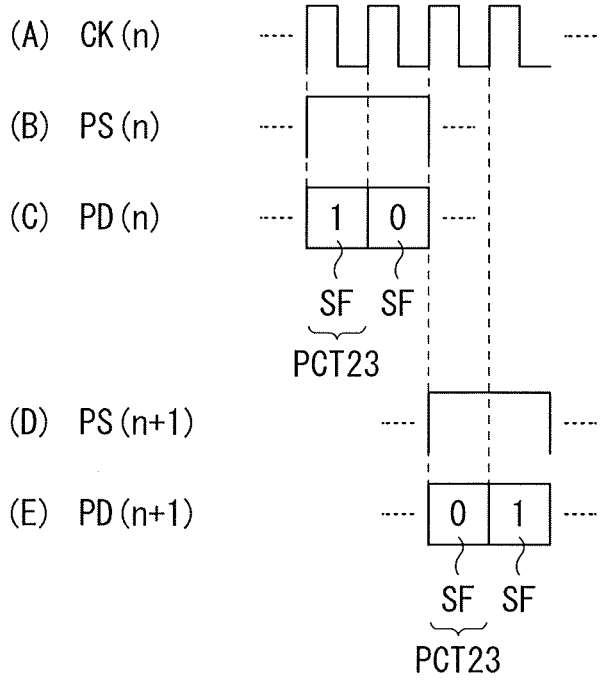
FIG. 19 is an explanatory diagram illustrating another operation example of the pixel according to the third embodiment.

FIG. 19 illustrates an operation in the nth pixel R(n) in a case where the pixel packet PCT23 in which the value of the start flag SF is "1" is supplied, and parts (A) to (C) in FIG. 19 indicate the clock signal CK(n) and the data signal PS(n) and PD(n) that are input to the pixel R(n), respectively, and parts (D) and (E) in FIG. 19 indicate the data signals PS(n+1) and PD(n+1) that are output from the pixel R(n), respectively.

The pixel R(n−1) previous to the pixel R(n) supplies, to the pixel R(n), the data signal PD(n) (the pixel packet PCT23) configured of the start flag SF indicating "1" together with the data signal PS(n) and the clock signal CK(n) (refer to the parts (A) to (C) in FIG. 19).

The control section 91 of the pixel R(n) acquires, as the start flag SF, the data signal PD(n) when the data signal PS(n) is turned to "1". In this example, since the start flag SF is "1", the control section 91 supplies the signals LD and PLT to the selector section 43, and the selector section 43 changes the start flag SF in the data signal PDA (refer to FIG. 16) into "0", and changes the start flag SF in a subsequent pixel packet (any one of the pixel packets PCT21 to PCT23) into "1" to generate the data signal PDB. Then, the pixel R(n) emits light with durations according to the luminance data IDR, IDG, and IDB that have been already read from a timing according to the light emission timing data ETD.

Then, the pixel R(n) generates the data signal PD(n+1) in such a manner, and outputs the data signal PD(n+1) together with the data signal PS(n+1) (refer to the parts (D) and (E) in FIG. 19).

In FIG. 19, a case where the pixel packet PCT23 in which the value of the start flag SF is "1" is supplied is illustrated; however, in a case where the pixel packet PCT23 in which the value of the start flag SF is "0" is supplied, the control section 91 does not generate the signals LD, PLT, and CKEN. Therefore, the pixel R(n) does not perform rewriting of the start flag SF and the end flag EF, and outputs the input data signals PS(n) and PD(n) without change as the data signals PS(n+1) and PD(n+1).

Next, as a more specific example, a case where a second pixel R(2) of four pixels R(0) to R(3) connected in a daisy chain fashion reads the luminance data ID and the light emission timing data ETD will be described below.

Figure 20:
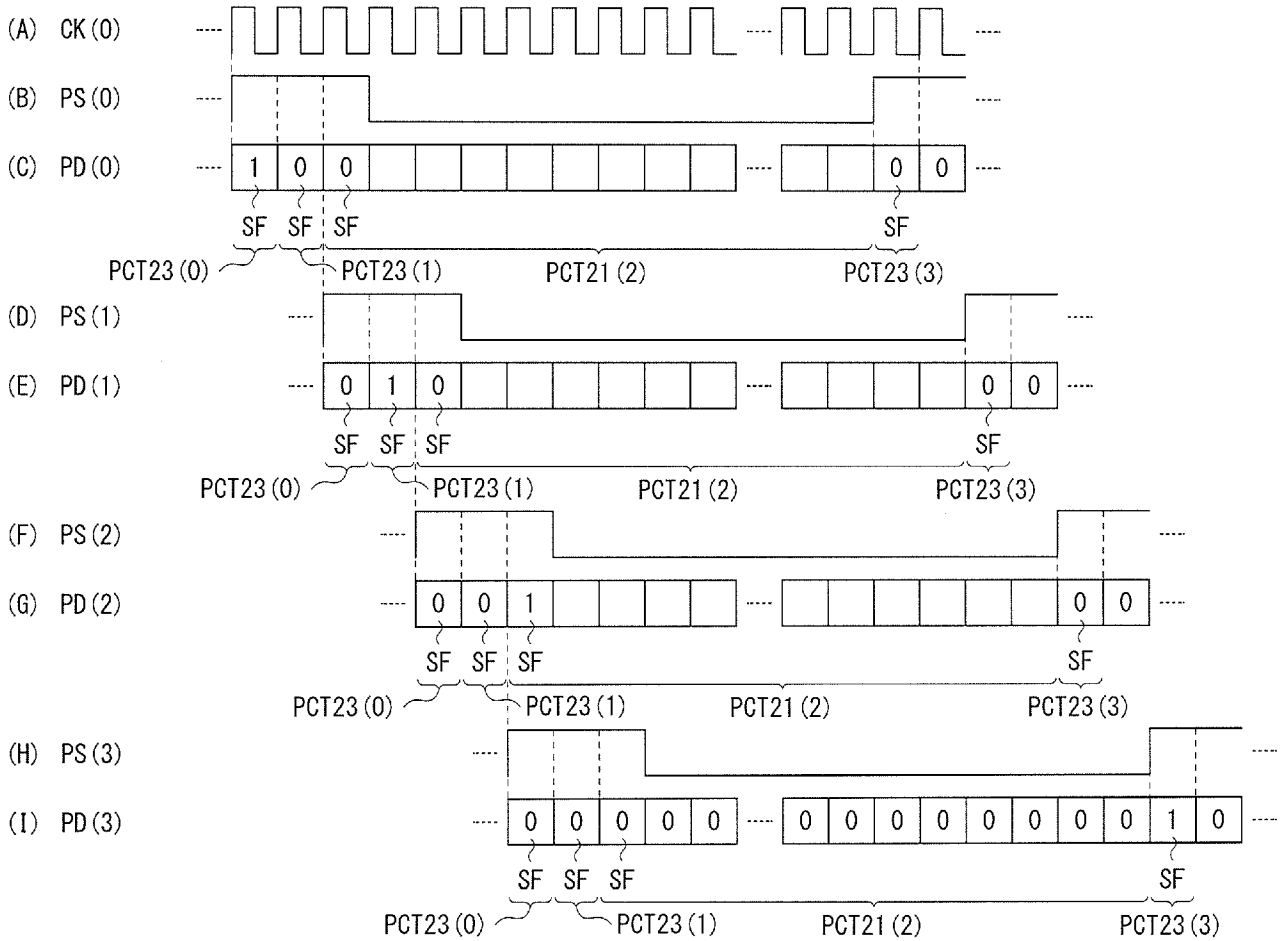
FIG. 20 is an explanatory diagram illustrating an operation example of the display panel according to the third embodiment.

FIG. 20 illustrates light emission operations in the pixels R(0) to R(3). Parts (A) to (C) in FIG. 20 indicate the clock signal CK(0) and the data signals PS(0) and PD(0) that are input to the pixel R(0), respectively, parts (D) and (E) in FIG. 20 indicate the data signals PS(1) and PD(1) that are input to the pixel R(1), parts (F) and (G) in FIG. 20 indicate the data signals PS(2) and PD(2) that are input to the pixel R(2), respectively, and parts (H) and (I) in FIG. 20 indicate the data signals PS(3) and PD(3) that are input to the pixel R(3), respectively.

The display drive section 80 generates the data signal PD(0) configured of a series of a pixel packet PCT23(0) for a 0th pixel R(0), a pixel packet PCT23(1) for a first pixel R(1), a pixel packet PCT21(2) for the second pixel R(2), and the pixel packet PCT21(3) for a third pixel R(3), and supplies, to the pixel R(0) in a first stage, the data signal PD(0) together with the data signal PS(0) and the clock signal CK(0) (refer to the parts (A) to (C) in FIG. 20). In other words, the display drive section 80 supplies the pixel packet PCT23 to the 0th, first, and third pixels R(0), (1), and R(3) that do not read the luminance data ID and the light emission timing data ETD, and supplies the pixel packet PCT21 to the second pixel R(2) that reads the luminance data ID and the light emission timing data ETD; therefore, such a data signal PD(0) is generated.

The pixel R(0) detects the start flag SF (the start flag SF of the pixel packet PCT23(0)) with a value of "1" in the data signal PD(0) (refer to the part (C) in FIG. 20), and changes the value of the start flag SF into "0". Moreover, the pixel R(0) detects the start flag SF (the start flag SF of the pixel packet PCT23(1)) with a value of "0" subsequent to that start flag SF, and changes the value of the subsequent start flag SF into "1". The pixel R(0) generates the data signal PD(1) in such a manner, and outputs the data signal PD(1) together with the data signal PS(1) (refer to the parts (D) and (E) in FIG. 20). Then, the pixel R(0) emits light with a duration according to the luminance data IDR, IDG, and IDB that have been already read at a timing according to the light emission timing data ETD that has been already read.

Likewise, the pixel R(1) detects the start flag SF (the start flag SF of the pixel packet PCT23(1)) with a value of "1" in the data signal PD(1) (refer to the part (E) in FIG. 20), and changes the value of the start flag SF into "0". Moreover, the pixel R(1) detects the start flag SF (the start flag SF of the pixel packet PCT21(2)) with a value of "0" subsequent to the start flag SF, and changes the value of the subsequent start flag SF into "1". The pixel R(1) generates the data signal PD(2) in such a manner, and outputs the data signal PD(2) together with the data signal PS(2) (refer to the parts (F) and (G) in FIG. 20). Then, the pixel R(1) emits light with durations according to the luminance data IDR, IDG, and IDB that have been already read from a timing according to the light emission timing data ETD that has been already read.

The pixel R(2) detects the start flag SF (the start flag SF of the pixel packet PCT21(2)) with a value of "1" in the data signal PD(1) (refer to the part (E) in FIG. 20), and changes the value of the start flag SF into "0". Then, the pixel R(2) reads data (the luminance data ID and the light emission timing data ETD) sandwiched between the start flag SF and a subsequent start flag SF (the start flag SF of the pixel packet PCT23(3)). Then, the pixel R(2) changes all of the data sandwiched between these start flags SF into "0", and changes the value of the subsequent start flag (the start flag SF of the pixel packet PCT23(3)) into "1". The pixel R(2) generates the data signal PD(3) in such a manner, and outputs the data signal PD(3) together with the data signal PS(3) (refer to the parts (H) and (I) in FIG. 20). Then, the pixel R(2) emits light with durations according to the luminance data IDR, IDG, and IDB read from the pixel packet PCT23(3) from a timing according to the light emission timing data ETD read from the pixel packet PCT23(3).

Figure 21:
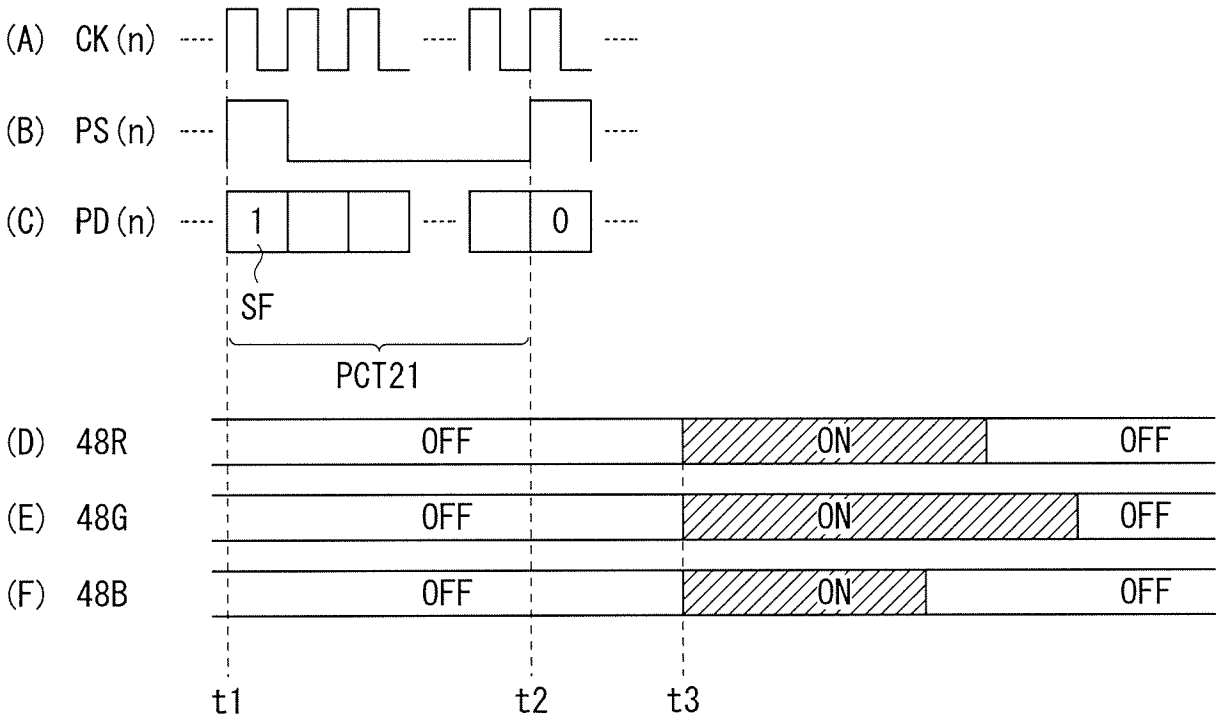
FIG. 21 is an explanatory diagram illustrating another operation example of the pixel according to the third embodiment.

FIG. 21 illustrates a light emission operation in the nth pixel R(n). Parts (A) to (C) in FIG. 21 indicate the clock signal CK(n) and the data signal PS(n) and PD(n) that are input to the pixel R(n), respectively, and parts (D) to (F) in FIG. 21 indicate light emission operations of light-emitting devices 48R, 48G, and 48B of the pixel R(n), respectively. In the parts (D) to (F) in FIG. 21, "ON" indicates a state in which the light-emitting devices 48R, 48G, and 48B emit light, and "OFF" indicates a state in which the light-emitting devices 48R, 48G, and 48B do not emit light.

The pixel R(n−1) previous to the pixel R(n) supplies, to the pixel R(n), the pixel packet PCT21 in which the value of the start flag SF is "1" in a period from a timing t1 to a timing t2 (refer to the part (C) in FIG. 21). Then, the pixel R(n) reads the luminance data IDR, IDG, and IDB, and the light emission timing data ETD from the pixel packet PCT21.

Next, the pixel R(n) allows the light-emitting devices 48R, 48G, and 48B of the pixel R(n) to emit light at a timing t3 that is set after a lapse of time according to the light emission timing data ETD from the timing t2 (refer to the parts (D) to (F) in FIG. 21). Then, the pixel R(n) allows the light-emitting device 48R, the light-emitting device 48G, and the light-emitting device 48B to emit light for periods with lengths according to the luminance data IDR, the luminance data IDG, and the luminance data IDB from the timing t3, respectively.

Thus, in the display panel 3, the pixel packets PCT21 to PCT23 each including the start flag SF are transmitted, and each pixel R determines, based on the start flag SF, whether or not to read the luminance data ID or the light emission timing data ETD; therefore, the luminance data ID or the light emission timing data ETD of an arbitrary pixel R of the N number of pixels R connected in a daisy chain fashion is allowed to be rewritten, and flexibility of the display operation is allowed to be enhanced.

Moreover, in the display panel 3, in a case where the start flag SF with a value of "1" is detected, the pixel R reads the luminance data ID and the light emission timing data ETD included in the pixel packets PCT21 and PCT22, and changes the value of the start flag SF and the value of the subsequent start flag SF into "0" and "1", respectively; therefore, a possibility that a plurality of pixels R read the luminance data ID and the light emission timing data ETD of same pixel packets PCT11 and PCT12 is allowed to be reduced.

Further, in the display panel 3, each pixel R reads the luminance data ID and the light emission timing data ETD, and performs the light emission operation, based on the read data; therefore, for example, the light emission start timing is allowed to be changed by the pixel R, and the display operation with higher flexibility is allowed to be performed.

As described above, in this embodiment, the pixel packet including the start flag is transmitted, and each pixel determines, based on the start flag, whether or not to read the luminance data or the light emission timing data, and the luminance data or the light emission timing data of an arbitrary pixel is allowed to be rewritten; therefore, flexibility of the display operation is allowed to be enhanced.

MODIFICATION EXAMPLE 3-1

In the above-described embodiment, three pixel packets PCT21 to PCT23 are used; however, the pixel packets are not limited thereto. For example, a pixel packet including the start flag SF and the luminance data ID and not including the light emission timing data ETD may be used.

MODIFICATION EXAMPLE 3-2

In the above-described embodiment, for example, the pixel packet PCT21 includes the light emission timing data ETD in addition to the luminance data ID; however, the pixel packet PCT21 is not limited thereto, and the pixel packet PCT21 may include another data for the operation of the pixel R. More specifically, for example, the pixel packet PCT21 may include data for instructing whether or not to allow the pixel R to emit light, data for adjusting a delay amount in the pixel R, or the like.

MODIFICATION EXAMPLE 3-3

Modification Examples 1-1 and 1-2 of the above-described first embodiment may be applied to the display panel 3 according to the above-described embodiment.

[4. Application Examples]

Next, application examples of the display panels described in the above-described embodiments and the above-described modification examples will be described below.

Figure 22:
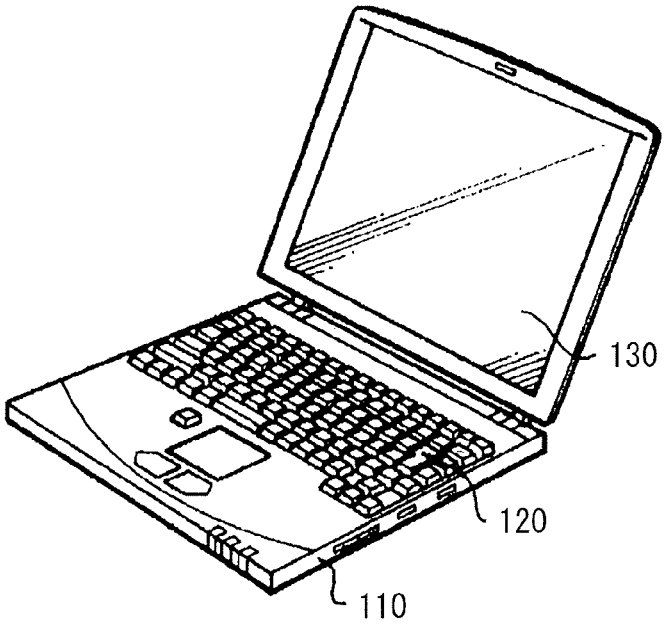
FIG. 22 is a perspective view illustrating an appearance of a notebook personal computer to which any of the embodiments and the like is applied.

FIG. 22 illustrates an appearance of a notebook personal computer to which any of the display panels according to the above-described embodiments and the like is applied. The notebook personal computer may include, for example, a main body 110, a keyboard 120, and a display section 130. Any one of the display panels according to the above-described embodiments and the like is applied to the display section 130.

Figure 23:
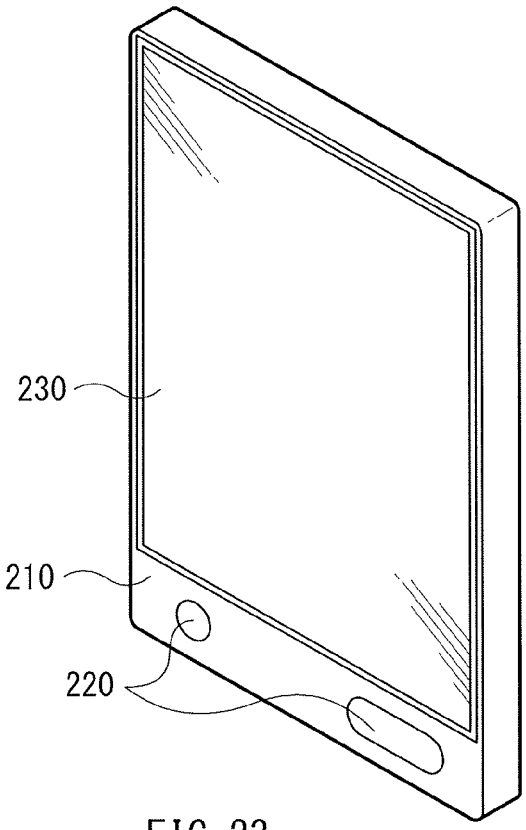
FIG. 23 is a perspective view illustrating an appearance of a smartphone to which any of the embodiments and the like is applied.

FIG. 23 illustrates an appearance of a smartphone to which any of the display panels according to the above-described embodiments and the like is applied. The smartphone may include, for example, a main body 210, an operation section 220, and a display section 230. Any one of the display panels according to the above-described embodiments and the like is applied to the display section 230.

The display panels according to the above-described embodiments and the like are applicable to electronic apparatuses in any fields such as monitors, televisions, digital cameras, and video cameras in addition to such electronic apparatuses. In other words, the display panels according to the above-described embodiments and the like are applicable to electronic apparatuses in any fields that display an image.

Although the present application is described referring to the embodiments, the modification examples thereof, and the application examples thereof to electronic apparatuses, the present application is not limited thereto, and may be variously modified.

For example, in the above-described first and second embodiments, each of the pixel packets PCT1 and PCT11 includes the variable data VD1 and the luminance data ID; however, the present application are not limited thereto, and the pixel packets PCT1 and the PCT11 may further include the light emission timing data ETD, as with the third embodiment.

Moreover, for example, in the above-described embodiments and the like, the LED is used as a display device; however, the present application is not limited thereto. Alternatively, an organic EL device may be used as a display device.

It is to be noted that the present application may have the following configurations.

(1) A display panel including:

a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels.

(2) The display panel according to (1), in which each of the unit pixels includes an input terminal, a memory configured to hold the luminance data, and an output terminal, the first pixel packet is supplied to the input terminal of a first unit pixel of the plurality of unit pixels, and the input terminal of one unit pixel other than the first unit pixel of the plurality of unit pixels is connected to the output terminal of one of the other unit pixels of the plurality of unit pixels.

(3) The display panel according to (2), in which the first pixel packet further includes first variable data, and each of the unit pixels determines, based on the first variable data, whether or not to read the luminance data included in the first pixel packet.

(4) The display panel according to (3), in which the first variable data included in the first pixel packet generated by the display drive section indicates a value specifying a unit pixel that is to rewrite the luminance data included in the first pixel packet, and each of the unit pixels changes a value of the first variable data included in the first pixel packet input to the input terminal thereof, and outputs the first pixel packet including the changed first variable data as a new first pixel packet from the output terminal thereof.

(5) The display panel according to (4), in which when the value of the first variable data is 0, each of the unit pixels reads the luminance data in the first pixel packet including the first variable data and changes the value of the first variable data to a value obtained by subtracting 1 from the pixel number of the plurality of unit pixels, and when the value of the first variable data is 1 or more, each of the unit pixels changes the value of the first variable data by decrementing the value of the first variable data.

(6) The display panel according to any one of (3) to (5), in which each of the unit pixels changes a value of the luminance data included in the first pixel packet into a predetermined value when each of the unit pixels reads the luminance data, and outputs the first pixel packet including the changed luminance data as a new first pixel packet from the output terminal thereof.

(7) The display panel according to any one of (1) to (6), in which the display drive section further generates a second pixel packet instructing the plurality of unit pixels to emit light.

(8) The display panel according to any one of (2) to (6), in which the display drive section further generates a second pixel packet including second variable data, and each of the unit pixels determines, based on the second variable data, whether or not to emit light.

(9) The display panel according to (8), in which the plurality of unit pixels are divided into two or more groups in rotation from the first unit pixel, and emit light in groups.

(10) The display panel according to (9), in which the second variable data included in the second pixel packet that is generated by the display drive section indicates a value specifying a unit pixel that is to emit light, and each of the unit pixels changes a value of the second variable data included in the second pixel packet input to the input terminal thereof, and outputs the second pixel packet including the changed second variable data as a new second pixel packet from the output terminal thereof.

(11) The display panel according to (10), in which when the value of the second variable data is 0, each of the unit pixels emits light, and changes the value of the second variable data into a value obtained by subtracting 1 from the number of the two or more groups, and when the value of the second variable data is 1 or more, each of the unit pixels changes the value of the second variable data by decrementing the value of the second variable data.

(12) The display panel according to (2), in which the first pixel packet includes flag data, and each of the unit pixels determines, based on a value of the flag data, whether or not to read luminance data included in the first pixel packet.

(13) The display panel according to (12), in which the display drive section further generates a second pixel packet including flag data and not including the luminance data.

(14) The display panel according to (13), in which the display drive section generates a pixel packet group including the first pixel packet and the second pixel packet, and each of the unit pixels changes two of a plurality of flag data included in the pixel packet group, and outputs the pixel packet group including the changed flag data as a new pixel packet group from the output terminal thereof.

(15) The display panel according to (14), in which the display drive section sets first flag data of the pixel packet group to a first value, and sets other flag data to a second value, when a value of the flag data in the first pixel packet is the first value, each of the unit pixels reads luminance data in the first pixel packet, changes the value of the flag data into the second value, and changes a value of flag data subsequent to the flag data into the first value, when a value of the flag data in the second pixel packet is the first value, each of the unit pixels changes the value of the flag data into the second value, and changes a value of flag data subsequent to the flag data into the first value, and when the values of the flag data in the first pixel packet and the second packet are the second value, each of the unit pixels does not change the flag data.

(16) The display panel according to any one of (12) to (15), in which the first pixel packet further includes timing data, the timing data configured to determine a light emission timing in a unit pixel into which luminance data included in the first pixel packet is to be written, and each of the unit pixels determines, based on the value of the flag data, whether or not to read the luminance data and the timing data included in the first pixel packet.

(17) The display panel according to any one of (2) to (16), in which a first unit pixel of two unit pixels adjacent to each other in the plurality of unit pixels supplies a clock signal and a data signal including the first pixel packet to a second unit pixel subsequent to the first unit pixel of the two pixels.

(18) The display panel according to (17), in which the data signal is encoded by one of NRZ encoding, Manchester encoding, and modified Miller encoding.

(19) A driving method comprising:

generating first pixel packets, the first pixel packets each including luminance data of a digital signal, the pieces of luminance data determining respective luminances of respective predetermined number of unit pixels of a plurality of unit pixels, and the first pixel packets being equal in number to the predetermined number of unit pixels; and supplying the first pixel packets to a display section including the plurality of unit pixels.

(20) An electronic apparatus provided with a display panel and a control section, the control section configured to perform operation control on the display panel, the display panel including:

a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display panel comprising:

a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels, wherein each of the unit pixels includes an input terminal, a memory configured to hold the luminance data, and an output terminal, wherein the first pixel packet is supplied to the input terminal of a first unit pixel of the plurality of unit pixels, wherein the input terminal of one unit pixel other than the first unit pixel of the plurality of unit pixels is connected to the output terminal of one of the other unit pixels of the plurality of unit pixels, and wherein a first unit pixel of two unit pixels adjacent to each other in the plurality of unit pixels is configured to supply a clock signal and a data signal including the first pixel packet to a second unit pixel subsequent to the first unit pixel of the two pixels.

2. The display panel according to claim 1, wherein the first pixel packet further includes first variable data, and each of the unit pixels is configured to determine, based on the first variable data, whether or not to read the luminance data included in the first pixel packet.

3. The display panel according to claim 2, wherein the first variable data included in the first pixel packet generated by the display drive section indicates a value specifying a unit pixel that is to rewrite the luminance data included in the first pixel packet, and each of the unit pixels changes a value of the first variable data included in the first pixel packet input to the input terminal thereof, and outputs the first pixel packet including the changed first variable data as a new first pixel packet from the output terminal thereof.

4. The display panel according to claim 3, wherein when the value of the first variable data is 0, each of the unit pixels reads the luminance data in the first pixel packet including the first variable data and changes the value of the first variable data to a value obtained by subtracting 1 from the pixel number of the plurality of unit pixels, and when the value of the first variable data is 1 or more, each of the unit pixels changes the value of the first variable data by decrementing the value of the first variable data.

5. The display panel according to claim 2, wherein each of the unit pixels changes a value of the luminance data included in the first pixel packet into a predetermined value when each of the unit pixels reads the luminance data, and outputs the first pixel packet including the changed luminance data as a new first pixel packet from the output terminal thereof.

6. The display panel according to claim 1, wherein the display drive section further generates a second pixel packet instructing the plurality of unit pixels to emit light.

7. The display panel according to claim 1, wherein the display drive section further generates a second pixel packet including second variable data, and each of the unit pixels determines, based on the second variable data, whether or not to emit light.

8. The display panel according to claim 7, wherein the plurality of unit pixels are divided into two or more groups in rotation from the first unit pixel, and emit light in groups.

9. The display panel according to claim 8, wherein the second variable data included in the second pixel packet that is generated by the display drive section indicates a value specifying a unit pixel that is to emit light, and each of the unit pixels changes a value of the second variable data included in the second pixel packet input to the input terminal thereof, and outputs the second pixel packet including the changed second variable data as a new second pixel packet from the output terminal thereof.

10. The display panel according to claim 9, wherein when the value of the second variable data is 0, each of the unit pixels emits light, and changes the value of the second variable data into a value obtained by subtracting 1 from the number of the two or more groups, and when the value of the second variable data is 1 or more, each of the unit pixels changes the value of the second variable data by decrementing the value of the second variable data.

11. The display panel according to claim 1, wherein the first pixel packet includes flag data, and each of the unit pixels determines, based on a value of the flag data, whether or not to read luminance data included in the first pixel packet.

12. The display panel according to claim 11, wherein the display drive section further generates a second pixel packet including flag data and not including the luminance data.

13. The display panel according to claim 12, wherein the display drive section generates a pixel packet group including the first pixel packet and the second pixel packet, and each of the unit pixels changes two of a plurality of flag data included in the pixel packet group, and outputs the pixel packet group including the changed flag data as a new pixel packet group from the output terminal thereof.

14. The display panel according to claim 13, wherein the display drive section sets first flag data of the pixel packet group to a first value, and sets other flag data to a second value, when a value of the flag data in the first pixel packet is the first value, each of the unit pixels reads luminance data in the first pixel packet, changes the value of the flag data into the second value, and changes a value of flag data subsequent to the flag data into the first value, when a value of the flag data in the second pixel packet is the first value, each of the unit pixels changes the value of the flag data into the second value, and changes a value of flag data subsequent to the flag data into the first value, and when the values of the flag data in the first pixel packet and the second packet are the second value, each of the unit pixels does not change the flag data.

15. The display panel according to claim 11, wherein the first pixel packet further includes timing data, the timing data configured to determine a light emission timing in a unit pixel into which luminance data included in the first pixel packet is to be written, and each of the unit pixels determines, based on the value of the flag data, whether or not to read the luminance data and the timing data included in the first pixel packet.

16. The display panel according to claim 1, wherein the data signal is encoded by one of NRZ encoding, Manchester encoding, and modified Miller encoding.

17. A driving method comprising:

generating first pixel packets, the first pixel packets each including luminance data of a digital signal, the pieces of luminance data determining respective luminances of respective predetermined number of unit pixels of a plurality of unit pixels, and the first pixel packets being equal in number to the predetermined number of unit pixels; and supplying the first pixel packets to a display section including the plurality of unit pixels, wherein each of the unit pixels includes an input terminal, a memory configured to hold the luminance data, and an output terminal, wherein the first pixel packet is supplied to the input terminal of a first unit pixel of the plurality of unit pixels, wherein the input terminal of one unit pixel other than the first unit pixel of the plurality of unit pixels is connected to the output terminal of one of the other unit pixels of the plurality of unit pixels, and wherein a first unit pixel of two unit pixels adjacent to each other in the plurality of unit pixels is configured to supply a clock signal and a data signal including the first pixel packet to a second unit pixel subsequent to the first unit pixel of the two pixels.

18. An electronic apparatus provided with a display panel, the display panel comprising:

a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels, wherein each of the unit pixels includes an input terminal, a memory configured to hold the luminance data, and an output terminal, wherein the first pixel packet is supplied to the input terminal of a first unit pixel of the plurality of unit pixels, wherein the input terminal of one unit pixel other than the first unit pixel of the plurality of unit pixels is connected to the output terminal of one of the other unit pixels of the plurality of unit pixels, and wherein a first unit pixel of two unit pixels adjacent to each other in the plurality of unit pixels is configured to supply a clock signal and a data signal including the first pixel packet to a second unit pixel subsequent to the first unit pixel of the two pixels.

19. A display panel comprising:

a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels, wherein each of the unit pixels includes an input terminal, a memory configured to hold the luminance data, and an output terminal, wherein the first pixel packet is supplied to the input terminal of a first unit pixel of the plurality of unit pixels, wherein the input terminal of one unit pixel other than the first unit pixel of the plurality of unit pixels is connected to the output terminal of one of the other unit pixels of the plurality of unit pixels, wherein the first pixel packet further includes first variable data, wherein each of the unit pixels is configured to determine, based on the first variable data, whether or not to read the luminance data included in the first pixel packet, wherein the first variable data included in the first pixel packet generated by the display drive section indicates a value specifying a unit pixel that is to rewrite the luminance data included in the first pixel packet, and wherein each of the unit pixels changes a value of the first variable data included in the first pixel packet input to the input terminal thereof, and outputs the first pixel packet including the changed first variable data as a new first pixel packet from the output terminal thereof.

20. A display panel comprising:

a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels, wherein each of the unit pixels includes an input terminal, a memory configured to hold the luminance data, and an output terminal, wherein the first pixel packet is supplied to the input terminal of a first unit pixel of the plurality of unit pixels, wherein the input terminal of one unit pixel other than the first unit pixel of the plurality of unit pixels is connected to the output terminal of one of the other unit pixels of the plurality of unit pixels, wherein the first pixel packet further includes first variable data, wherein each of the unit pixels is configured to determine, based on the first variable data, whether or not to read the luminance data included in the first pixel packet, and wherein each of the unit pixels changes a value of the luminance data included in the first pixel packet into a predetermined value when each of the unit pixels reads the luminance data, and outputs the first pixel packet including the changed luminance data as a new first pixel packet from the output terminal thereof.

21. A display panel comprising:

a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels, wherein each of the unit pixels includes an input terminal, a memory configured to hold the luminance data, and an output terminal, wherein the first pixel packet is supplied to the input terminal of a first unit pixel of the plurality of unit pixels, wherein the input terminal of one unit pixel other than the first unit pixel of the plurality of unit pixels is connected to the output terminal of one of the other unit pixels of the plurality of unit pixels, wherein the display drive section further generates a second pixel packet including second variable data, and each of the unit pixels determines, based on the second variable data, whether or not to emit light, wherein the plurality of unit pixels are divided into two or more groups in rotation from the first unit pixel, and emit light in groups, wherein the second variable data included in the second pixel packet that is generated by the display drive section indicates a value specifying a unit pixel that is to emit light, and wherein each of the unit pixels changes a value of the second variable data included in the second pixel packet input to the input terminal thereof, and outputs the second pixel packet including the changed second variable data as a new second pixel packet from the output terminal thereof.

22. A display panel comprising:

a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels, wherein each of the unit pixels includes an input terminal, a memory configured to hold the luminance data, and an output terminal, wherein the first pixel packet is supplied to the input terminal of a first unit pixel of the plurality of unit pixels, wherein the input terminal of one unit pixel other than the first unit pixel of the plurality of unit pixels is connected to the output terminal of one of the other unit pixels of the plurality of unit pixels, wherein the first pixel packet includes flag data, and each of the unit pixels determines, based on a value of the flag data, whether or not to read luminance data included in the first pixel packet, wherein the display drive section further generates a second pixel packet including flag data and not including the luminance data, wherein the display drive section generates a pixel packet group including the first pixel packet and the second pixel packet, and wherein each of the unit pixels changes two of a plurality of flag data included in the pixel packet group, and outputs the pixel packet group including the changed flag data as a new pixel packet group from the output terminal thereof.

23. A display panel comprising:

a display section including a plurality of unit pixels; and a display drive section configured to generate first pixel packets and supply the first pixel packets to the display section, the first pixel packets each including luminance data of a digital signal, the pieces of luminance data determining respective luminances of respective predetermined number of unit pixels of the plurality of unit pixels, and the first pixel packets being equal in number to the predetermined number of unit pixels, wherein each of the unit pixels includes an input terminal, a memory configured to hold the luminance data, and an output terminal, wherein the first pixel packet is supplied to the input terminal of a first unit pixel of the plurality of unit pixels, wherein the input terminal of one unit pixel other than the first unit pixel of the plurality of unit pixels is connected to the output terminal of one of the other unit pixels of the plurality of unit pixels, wherein the first pixel packet includes flag data, and each of the unit pixels determines, based on a value of the flag data, whether or not to read luminance data included in the first pixel packet, wherein the first pixel packet further includes timing data, the timing data configured to determine a light emission timing in a unit pixel into which luminance data included in the first pixel packet is to be written, and wherein each of the unit pixels determines, based on the value of the flag data, whether or not to read the luminance data and the timing data included in the first pixel packet.

* * * * *